US005160939A

United States Patent [19]

Bajeux et al.

[11] Patent Number: 5,160,939

[45] Date of Patent: Nov. 3, 1992

[54] DEVICE FOR CONTROLLING AND REGULATING AN INK AND PROCESSING THEREOF IN A CONTINUOUS INK JET PRINTER

[75] Inventors: Paul Bajeux, Bourg De Peage; Alain Dunand, Valence, both of France

[73] Assignee: Imaje S.A., Bourg-Les-Valence, France

[21] Appl. No.: 460,337

[22] PCT Filed: Sep. 11, 1989

[86] PCT No.: PCT/FR89/00484

§ 371 Date: May 17, 1990

§ 102(e) Date: May 17, 1990

[87] PCT Pub. No.: WO90/03271

PCT Pub. Date: Apr. 5, 1990

[30] Foreign Application Priority Data

Sep. 29, 1988 [FR] France ..... 88 12935

[51] Int. Cl.[5] ..... E01D 15/18

[52] U.S. Cl. ..... 346/75

[58] Field of Search ..... 346/75, 140

[56] References Cited

U.S. PATENT DOCUMENTS

| | | | |
|---|---|---|---|
| 3,852,768 | 12/1974 | Carmichael et al. | 346/75 |
| 4,323,908 | 4/1982 | Lee et al. | 346/140 R |
| 4,417,256 | 11/1983 | Fillmore et al. | 346/75 |
| 4,612,553 | 9/1986 | Kohler | 346/1.1 |

FOREIGN PATENT DOCUMENTS

| | | |
|---|---|---|
| 55-19514 | 2/1980 | Japan . |
| 60-255443 | 12/1985 | Japan . |

*Primary Examiner*—Benjamin R. Fuller
*Assistant Examiner*—Gerald E. Preston
*Attorney, Agent, or Firm*—Roland Plottel

[57] ABSTRACT

A device for controlling and regulating a continuous ink jet printer wherein a jet (J) is fractionated into droplets charged in a charge electrode (6) and which then pass between deflection electrodes, a sensor (8) is provided which includes a conductor element (8c) having two parts which are symmetrical with respect to the trajectory of the droplets. The device includes a circuit (9) which determines and processes the first I(t) and second J(t) derivatives with respect to the time of the charge induced in the conductor element (8c) by charged droplets (Gc) in order to determine their speed. The device includes means for regulating the speed of droplets and means for regulating the ink quality.

15 Claims, 18 Drawing Sheets

DEVICE FOR CONTROLLING AND REGULATING AN INK AND PROCESSING THEREOF IN A CONTINUOUS INK JET PRINTER

The present invention relates to devices for the control and regulation of ink and processing thereof in a continuous ink jet printer.

The ink projection writing technique, using a continuous jet of calibrated droplets delivered by a modulation system, consists in charging these droplets electrostatically by means of an appropriate electrode. The passage of these variably charged drops between two electrodes brought to a high electric potential difference leads to deflection of the drops proportional to their charge. Such deflection combined with the movement of the medium makes possible the matrix printing of characters or graphisms on said medium.

The set of parameters conditioning the operation of the printer must be controlled so as to ensure a constant quality of the printing despite the inevitable variations of the environment.

The speed of the drops is the parameter having the most influence on the printing quality, for it conditions the passage time of the charged drops through the deflecting electric field (and so the path of the printed drops), but also the phenomenon of formation end electric charging of the drops in the charging electrode.

The quality of the ink also forms a very influential factor in the operation of printers for several reasons.

In the first place, the physical properties of the ink (viscosity, density, surface tension) condition the flow of the ink through the nozzle, as well as the physical process of formation of the drops. The main factors leading to variation of the physical properties of the ink are evaporation of the solvent of the ink and temperature variations.

In the second place, the chemical qualities of the ink which result from the concentrations of the different components of the ink must be kept constant in time. The dye concentration must be controlled so as to ensure constancy of the optical quality of the marks on the printed medium (optical density, colour, etc..). The amount of resin present in the ink must be controlled for it conditions, in certain formulations, the electric conductivity of the ink and so the electric charge of the drops. The amount of resin must in particular be controlled for the applications in which physical-chemical processing is applied to the printed deposit in a phase which is simultaneous with or subsequent to the marking, such as cross-linking under ultra-violet rays, reaction under radiation, etc.., so as to confer thereon special chemical resistance properties.

The process of formation and electric charging of the drops also conditions the printing quality. A spectacular characteristic of malfunctioning of a printer related to a defect in the process of formation of the drops is pollution of the deflection electrodes by small parasite droplets commonly called satellite drops. The process of formation and electric charging of the drops results from the interaction of complex hydrodynamic and electric phenomena, still not well described by theory. The influential parameters on this process are related both to the physico-chemical properties of the ink and to the operating characteristics of the machine : geometry, jet speed, modulation frequency and amplitude.

The purpose of the invention is to make possible control and regulation of the most influential parameters on the printing quality of an ink jet printer; drop speed, ink quality and process of formation and charging of the drops.

More particularly, an important object of the invention consists in providing control and regulation devices which are simple and compact, so adapted to compact ink jet printers.

Another important object of the invention consists in providing control and regulation devices which can be used reliably under severe and very variable environmental conditions (temperature, humidity, ventilation), as well as with different types of ink.

A field of application to which the present invention is particularly related is the field of industrial marking, in which the environmental conditions are very different and very variable in time :

- very different ambient temperatures depending on the industrial activity and large amplitudes of variation of this temperature (printing in a cold chamber, outside printing);
- use of very volatile solvents (methylethylketone, alcohols, etc..) whose evaporation depends very much on the environment (temperature, ventilation, etc..);
- use of very different ink formulations, generally chosen as a function of the nature of the medium to be printed (paper, metal, glass, plastic materials, etc..).

Different devices have been perfected for controlling and regulating the parameters which are the most influential on the printing quality of an ink jet printer.

In so far as the drop speed is concerned, in electrostatic printers, namely printers using electrostatically charged drops, a conducting element detects the proximity of the charged drops. In the U.S. Pat. No. 313 913, a method is described for detecting charged drops using such a device. Furthermore, the U.S. Pat. No. 3 852 768 describes the use of two separate inductive detectors placed along the path of charged drops and the associated speed measurement given by the difference between the passage time of these drops past the detectors. In the European patent application 84 460003.1 in the name of the present Applicant, a particular embodiment of a detection system is described in which the two inductive detectors are integrated in a single split detection electrode placed in the axis of the path of the drops.

Generally, most of the inventions related to the use of inductive detectors for measuring the speed of charged drops mention the need to use at least two detectors. The major drawback of these double detector devices resides in the space required.

In the Swiss patent 251/84 a description is to be found relative to the use of a single inductive detector for measuring the speed of charged drops. However, in this patent, no mention is made of the conditions concerning the size of the detector and which are necessary for putting the process into practice. Furthermore, few details concern the circuit for processing the associated signal. It is mentioned that the latter delivers an alternating signal frequency "almost proportional" to the drop speed.

According to the invention, the drop speed is measured by means of a single detector comprising a conducting element in two parts which are symmetrical with respect to the path of the drops, said detector being located between the charging electrode and the deflection electrodes. The conducting element of the detector is connected to ground through a resistor to the terminals of which a processing circuit is connected. A charged drop, or a train of charged drops, induces a charge of opposite sign in the detector element and this charge varies depending on the position of the charged drop, or on the train of charged drops in the detector. The processing of the first derivative I(t) and of the second derivative J(t) with respect to time of the charge Q(t) makes it possible to determine the times at which the charged drop, or train of charged drops, enters or leaves the detector and, consequently, its speed, the length of the detector being known.

In a preferred embodiment of the invention, the length of the detector is greater than the spacing between its two symmetrical parts with respect to the path of the drops.

Concerning the control of the ink quality, to compensate for the permanent evaporation of the solvent in the environment, the operation of most ink circuits in ink jet printers consists in permanently measuring by means of a viscosimeter the viscosity of the ink in the ink circuit and regulation of the viscosity of the ink supplying the nozzle by addition of solvent or fresh ink. A description of an ink circuit operating with this principle is given in particular in the U.S. Pat. No. 4 628 329 in the name of the present Applicant. The incorporation of the viscosimeter function in the ink circuit appreciably increases the complexity of its operation and generally leads to considerable additional space requirement.

Furthermore, the viscosity measurement position is generally remote from the printing head. At a given moment, the viscosity measured in the ink circuit may not be representative of the actual viscosity at the printing head. This is particularly true when the temperature at the viscosity measurement position is different from the temperature at the printing head. To overcome this drawback, different solutions for regulating the temperature of the ink in the printing head have been proposed, generally incorporating a heating element (see the U.S. Pat. No. 4 337 468 to RICOH or 4 403 227 to IBM) which increases the complexity and energy consumption of the printer.

Another object of the present invention consists in measuring the "ink quality" at the printing head, without requiring a viscosimeter function properly speaking.

This object is attained, in accordance with the invention, by combining the use of a device for measuring the drop speed, an electronic circuit and a device for supplying the nozzle with ink cooperating in regulating the drop speed and measurement of the ink pressure in the ink circuit associated with dimensioning rules of the hydraulic ducts.

Another object of the invention consists in measuring a temperature representative of the temperature of the ink at the nozzle, and correcting the quality of the ink by addition of solvent or fresh ink, in accordance with a law which takes the temperature into account.

The invention also provides optimization of the speed of regulation of the ink quality, by taking into account the flow and homogenization time of the ink between the ink (or solvent) addition position and the nozzle and by using a make-up ink cartridge containing an ink whose concentration is higher than the nominal value of use.

Concerning the control of the formation of the drops in ink jet printers of the continuous ink jet type, the pressurized ink is injected by a nozzle in the form of a jet which is caused to break up into a succession of droplets to which a charge is then applied selectively and which are directed towards the printing medium or towards a gutter. Different processes may be used for controlling and synchronizing the droplet formation, consisting in vibrating the nozzle, or causing disturbances of the pressure of the ink at the level of the nozzle by incorporating in particular a resonator energized by a piezoelectric ceramic upstream of the nozzle. Because of the disturbance, the jet is broken up at the disturbance frequency into uniform droplets, often accompanied by smaller droplets called satellite droplets. The presence of these satellite drops may be controlled for, during application of the charge to the drops, the satellites have a higher charge per unit of mass than the main drops: if the satellites pass into the deflection field, they undergo considerable deflection and cause either soiling of the deflection electrodes leading to electric insulation defects or parasite impacts on the printed medium.

The prior art (see the article by BOGY in the Annual Review of Fluid Mechanics 1979) shows that if the physical properties of the ink, the nozzle, the disturbance frequency, the speed of the jet, the resonator device and the form of the energization signal applied to the resonator are fixed, it is possible to control the formation of the drops by the amplitude of the disturbance applied to the resonator. It is possible, in particular, to inhibit the formation of satellite droplets by choosing an amplitude adapted to the disturbance. Furthermore, the value of this amplitude determines the position at which the jet is broken up at a given distance with respect to the position of the nozzle (and so with respect to the charging electrode).

The means used for applying the chosen electric charge to each droplet generally comprise a charging circuit and an electrode surrounding the jet at the position of formation of the drop. The electrostatic charge of the drop is then obtained by applying a voltage of amplitude Vc between a point of electric contact with the ink and the charging electrode. The charge Qg acquired by the drop then depends on the value of the charging voltage Vc at the time of formation of the drop, on the electric capacity Cg of the drop being formed/charging control assembly, and on the ratio of the period of formation of the drops to the electric characteristic time of the jet/electrode assembly, defined by Rj.Cj where Rj is the equivalent electric resistance of the jet between the nozzle and the drop being formed and Cj is the electric capacity of the jet/electrode assembly. The parameters Rj, Cj, Cg are in particular influenced by the form of the jet during the drop formation and charging period. The electric resistance of the jet Rj further depends on the electric conductivity of the ink, itself generally depending on the concentration and on the temperature of the ink.

For a given printing head and ink, experience shows that it is possible to determine a relation between the physical properties of the ink at the nozzle (rheology, surface tension) and the energization amplitude of the resonator so as to obtain a correct formation of the drops, namely so that the separation point of the drops of the jet is close to centre of the charging electrode, and so that formation of satellite drops is inhibited.

In accordance with the invention, the process of formation and charging of the drops is controlled and regulated by simultaneously regulating the drop speed, the quality of the ink and the position at which the drops of the jet separate. Control of the position at which the drops separate is obtained by controlling the flight time of the drops between the drop charging position and the position of the drop speed detector. Regulation of the drop separation position is obtained by modifying the amplitude of energization of the resonator so as to maintain the drop separation position at a position called operating point, which depends on the quality of the ink measured at the nozzle.

The characteristics of the invention mentioned above, as well as others, will be clear from the following description of a preferred embodiment, with reference to the accompanying drawings, in which.

Figure 3A:
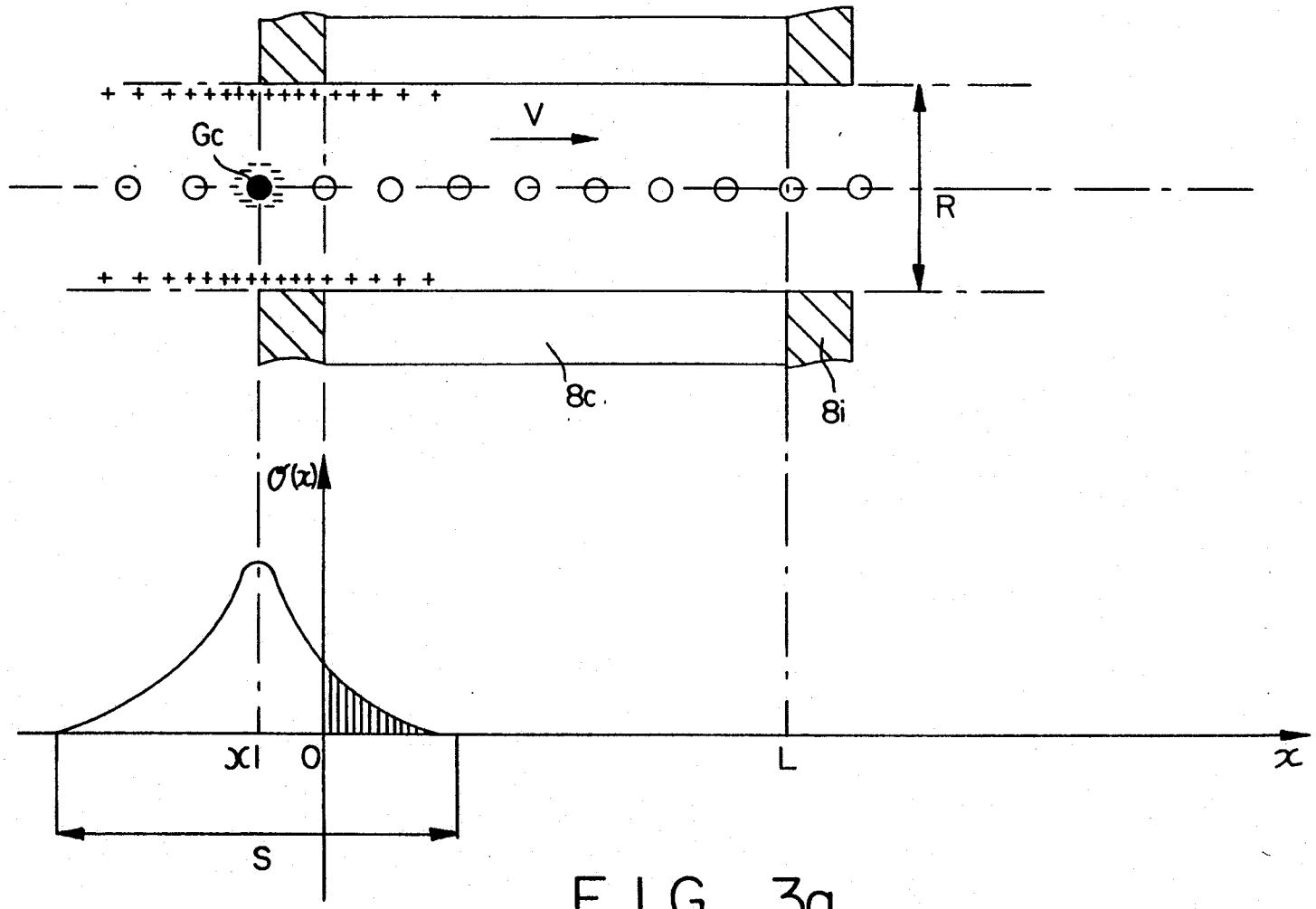
Figure 3B:
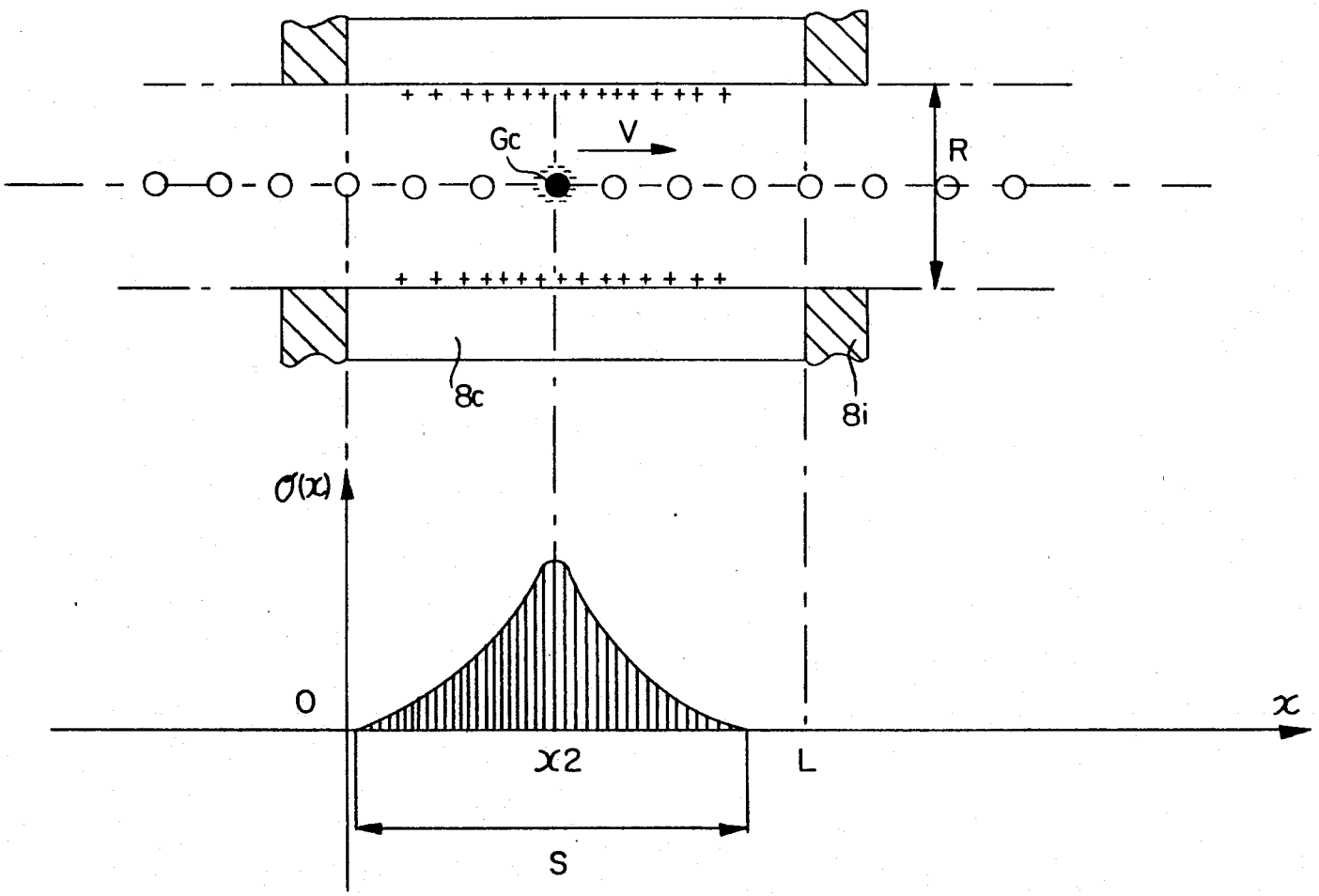
Figure 3C:
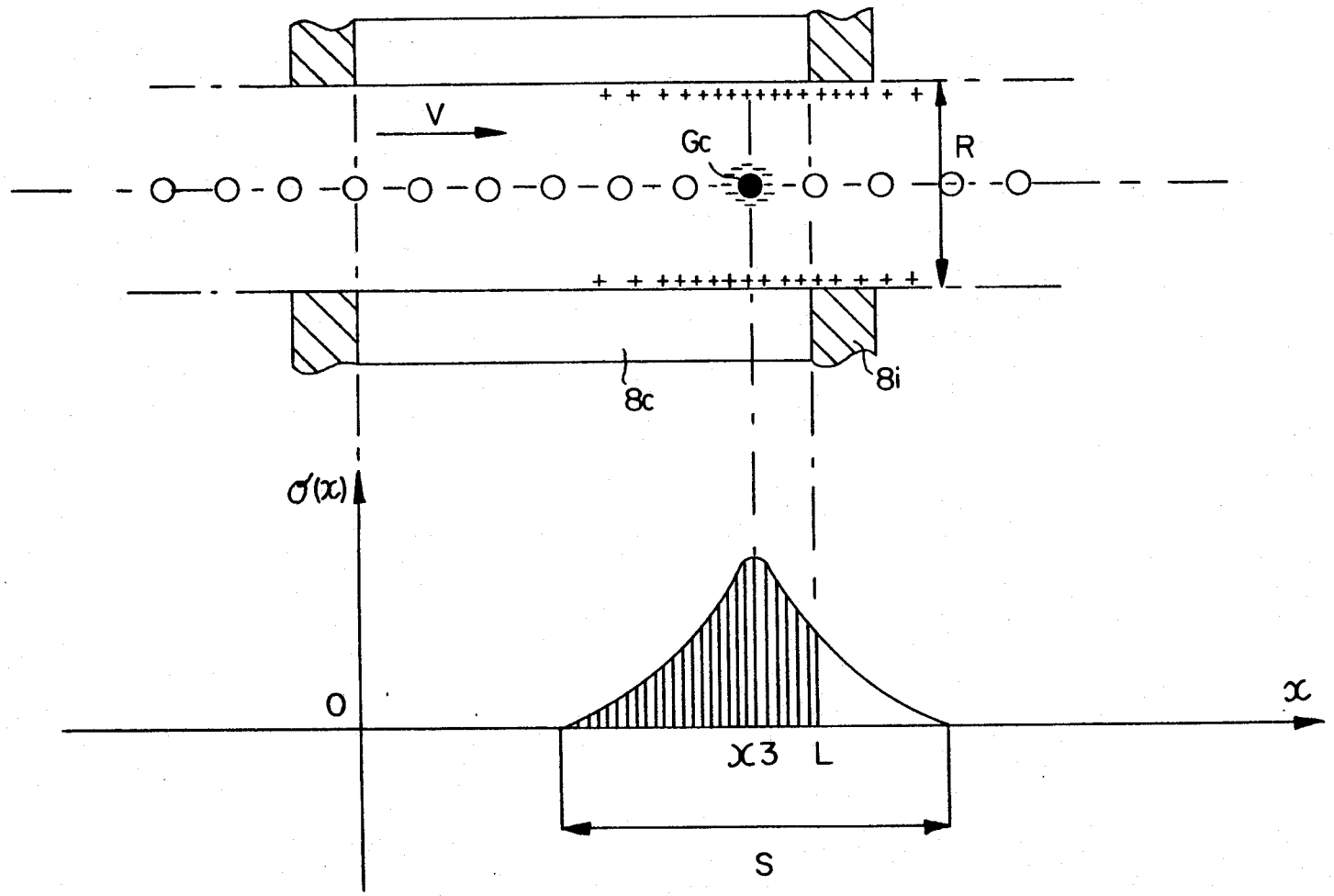
Figure 3D:
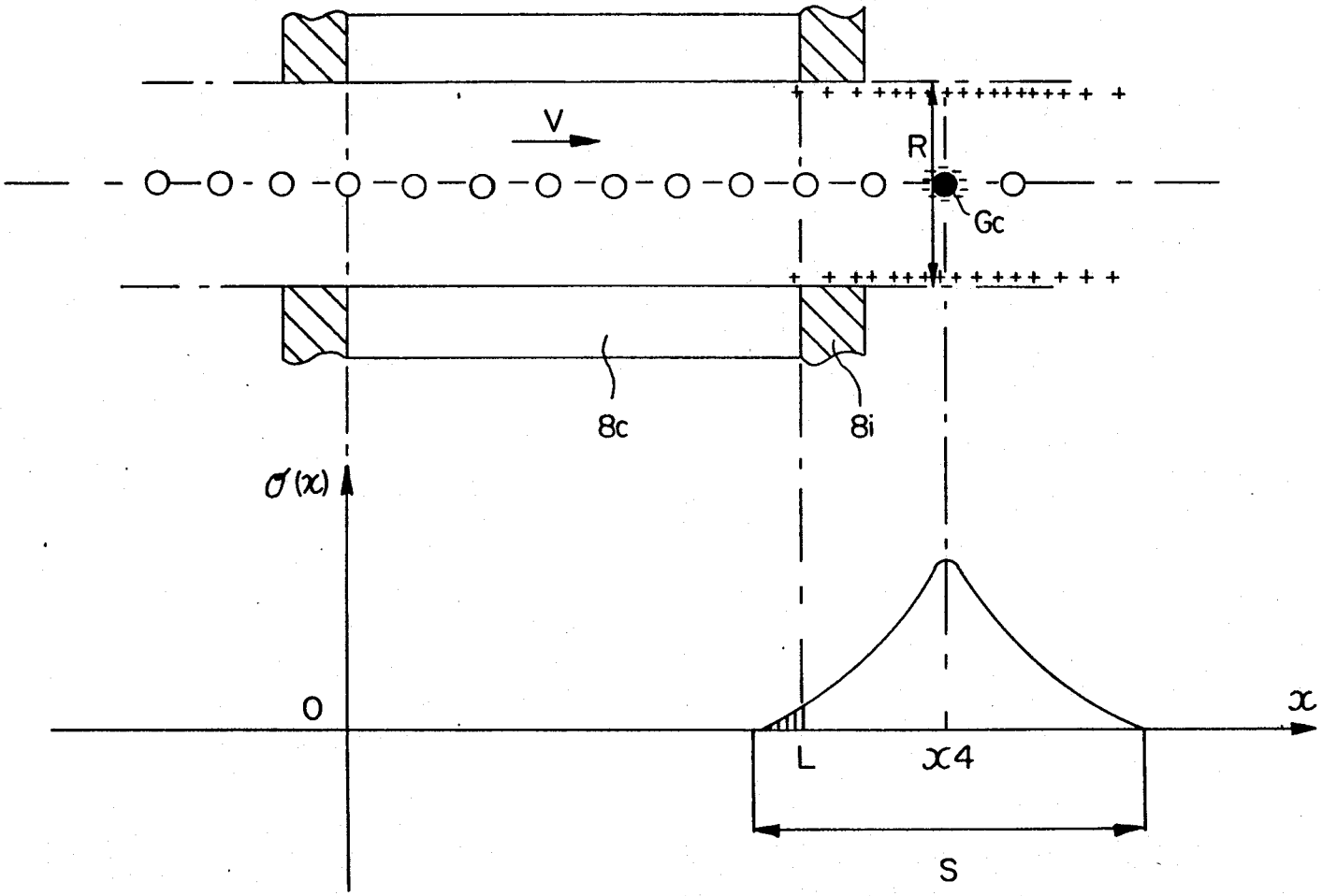
Figure 4:
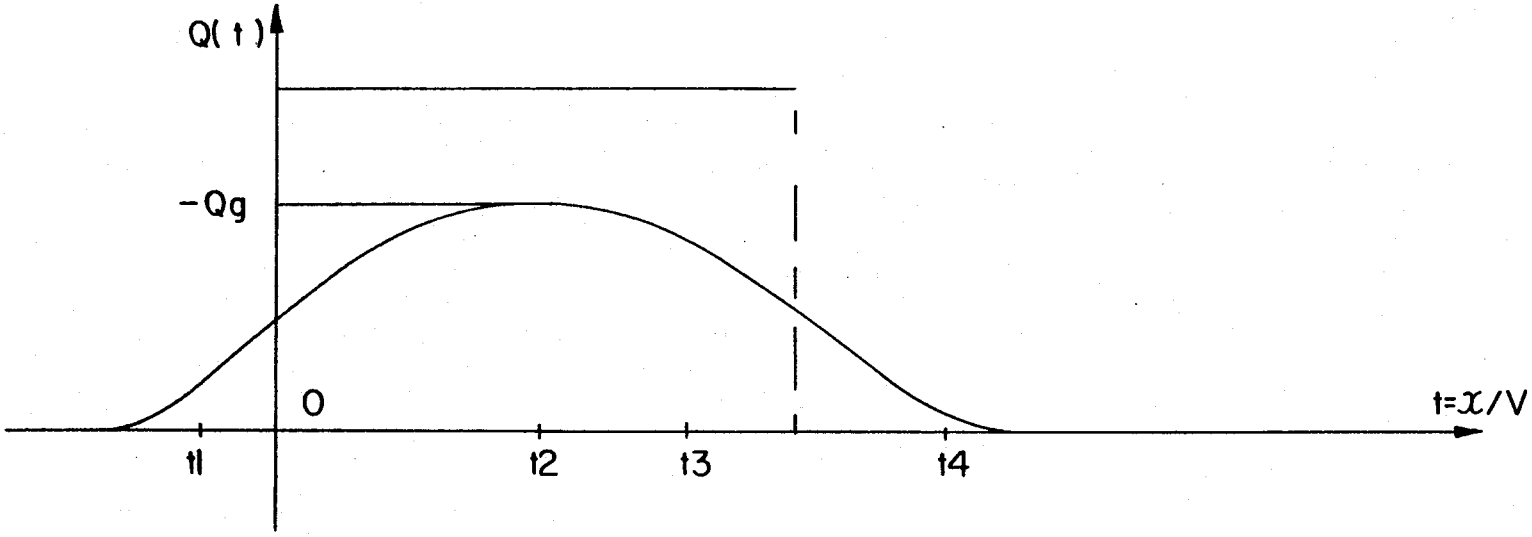
Figure 5:
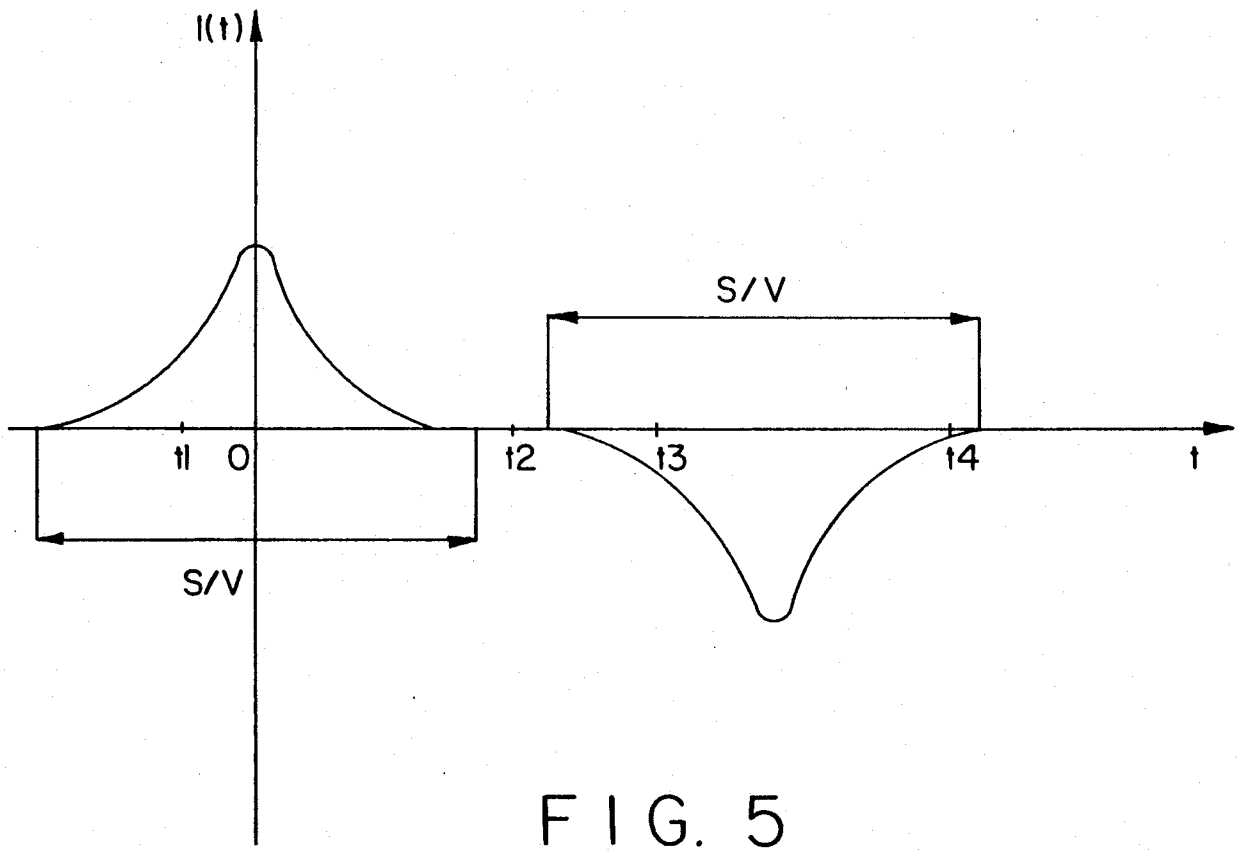
Figure 6:
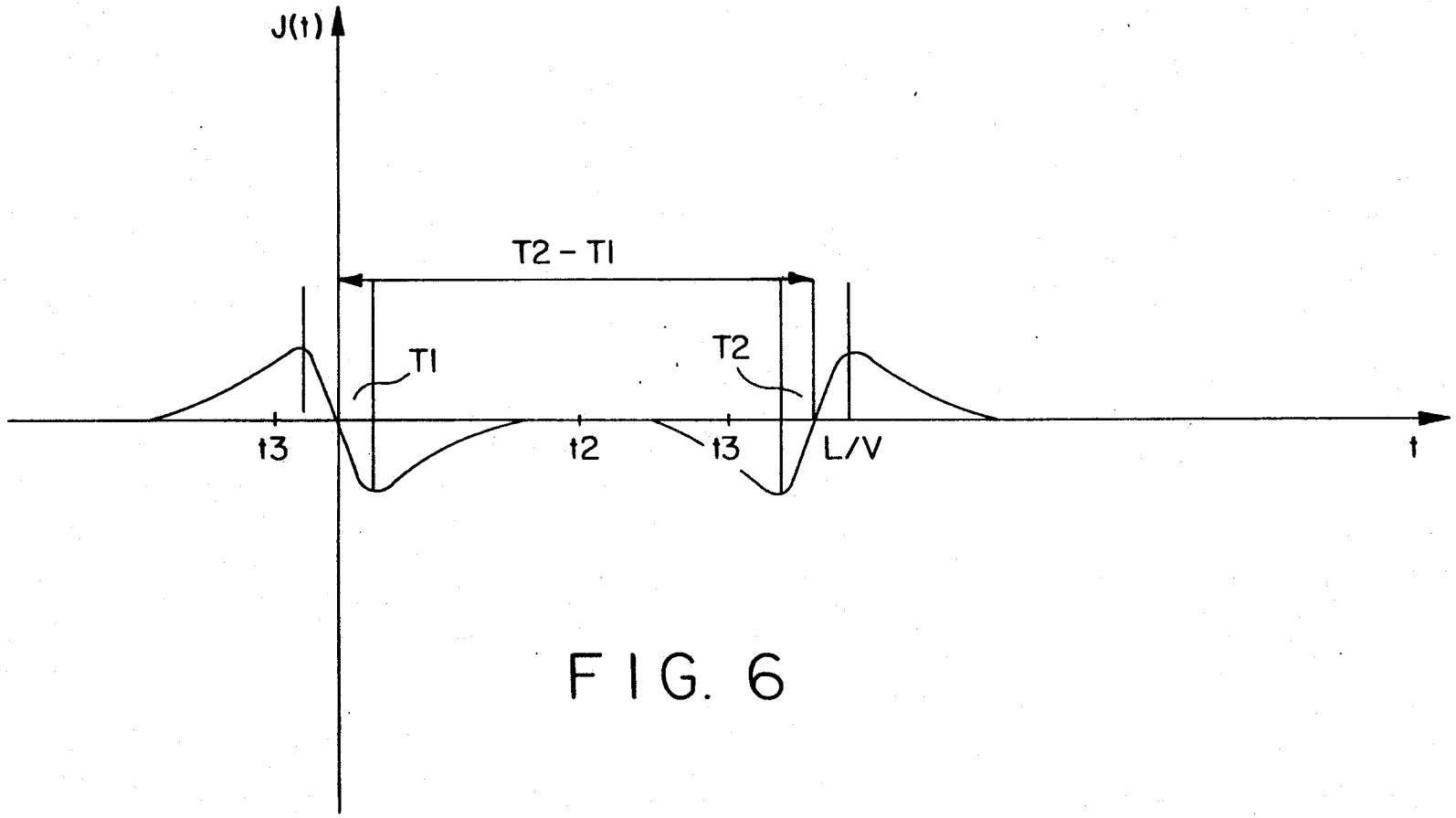
Figure 7:
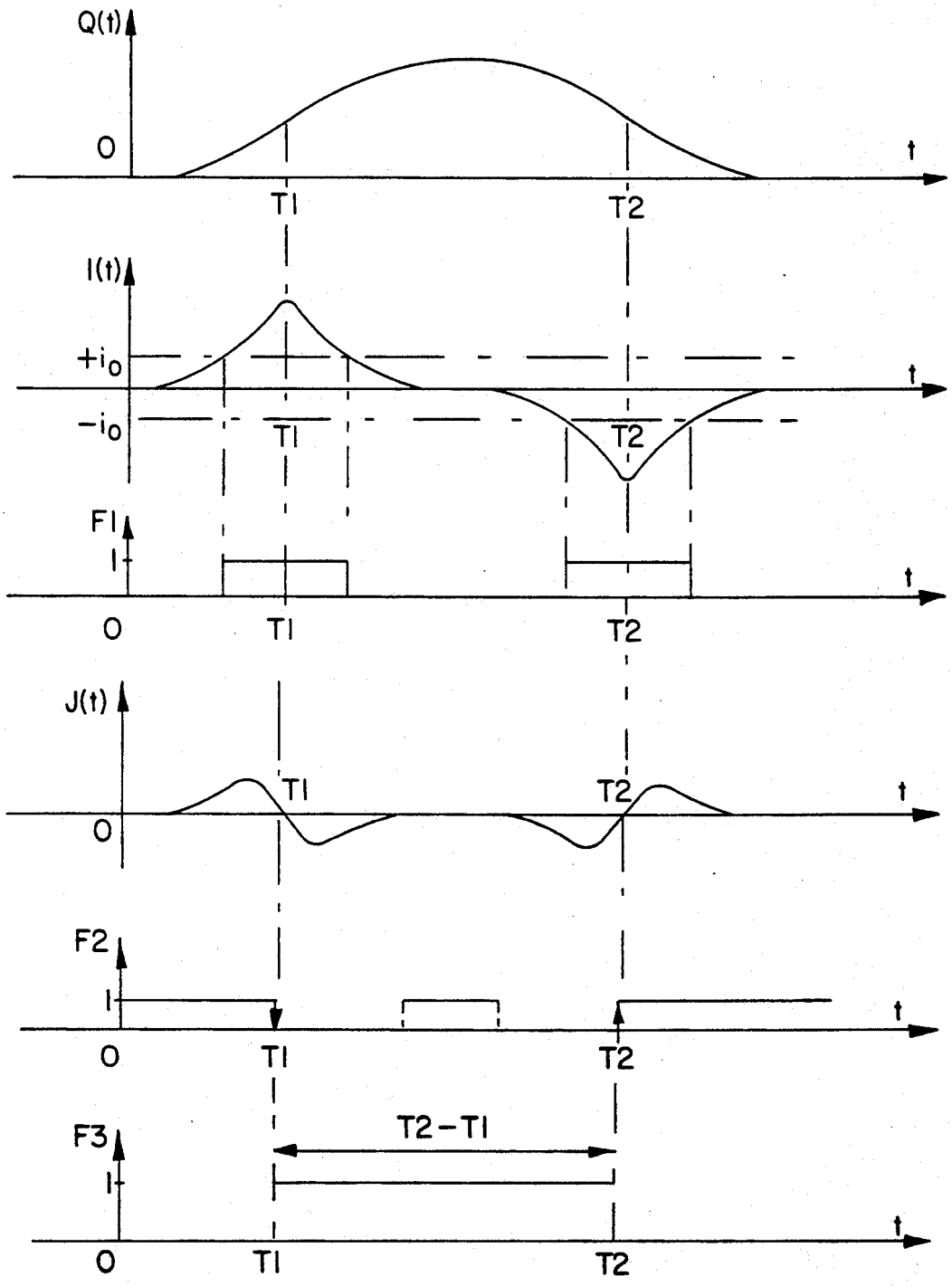
Figure 8:
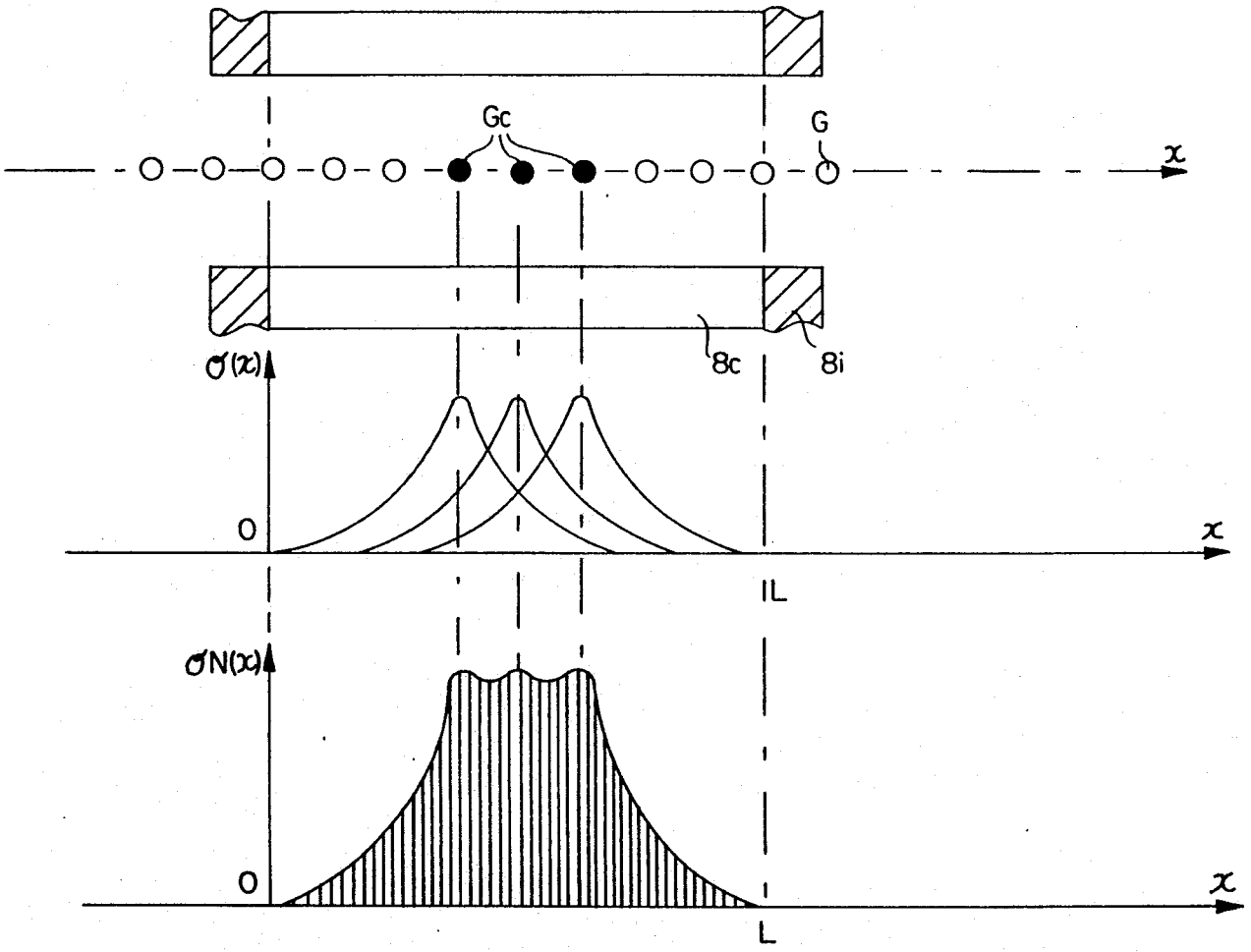
Figure 9:
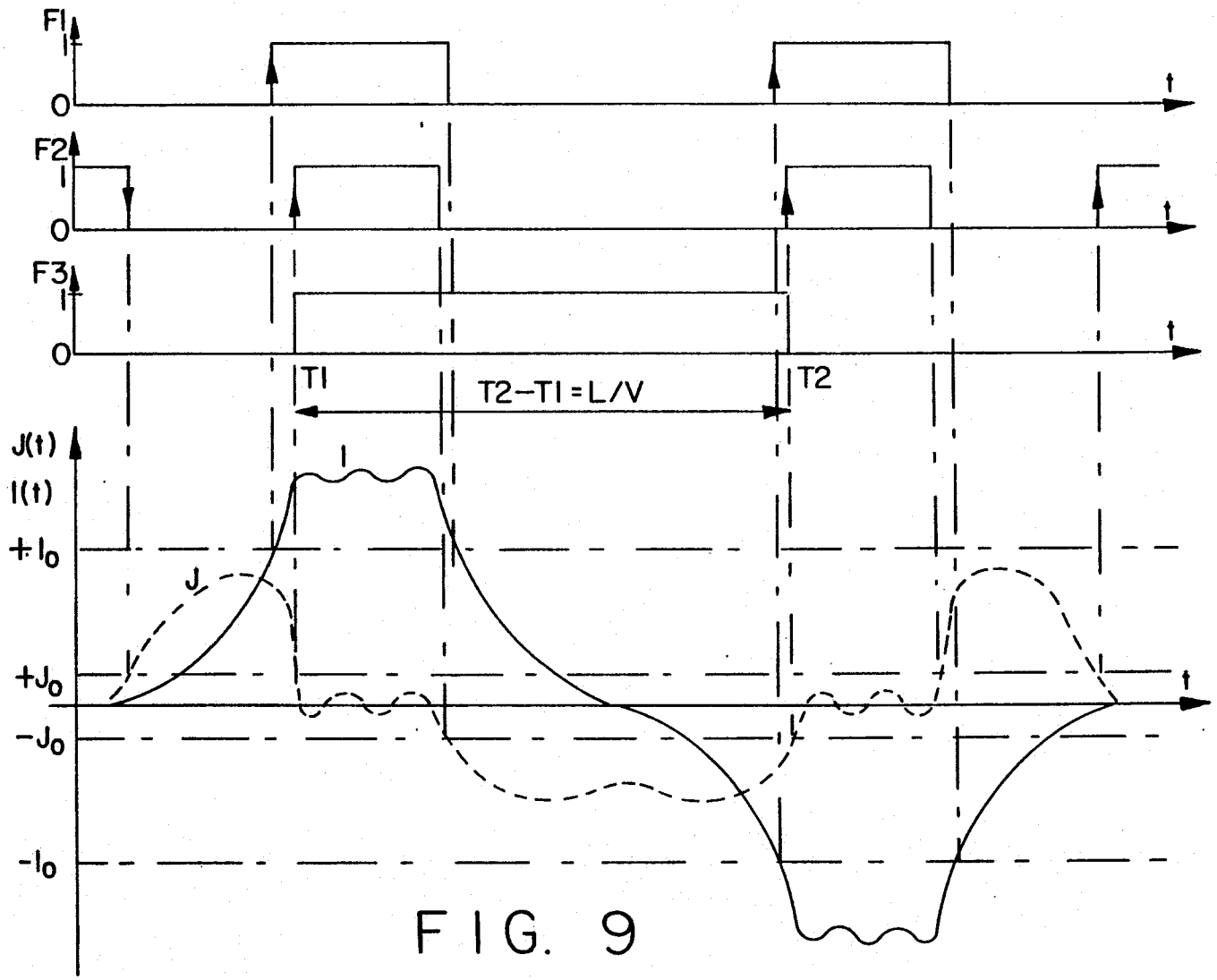
Figure 10:
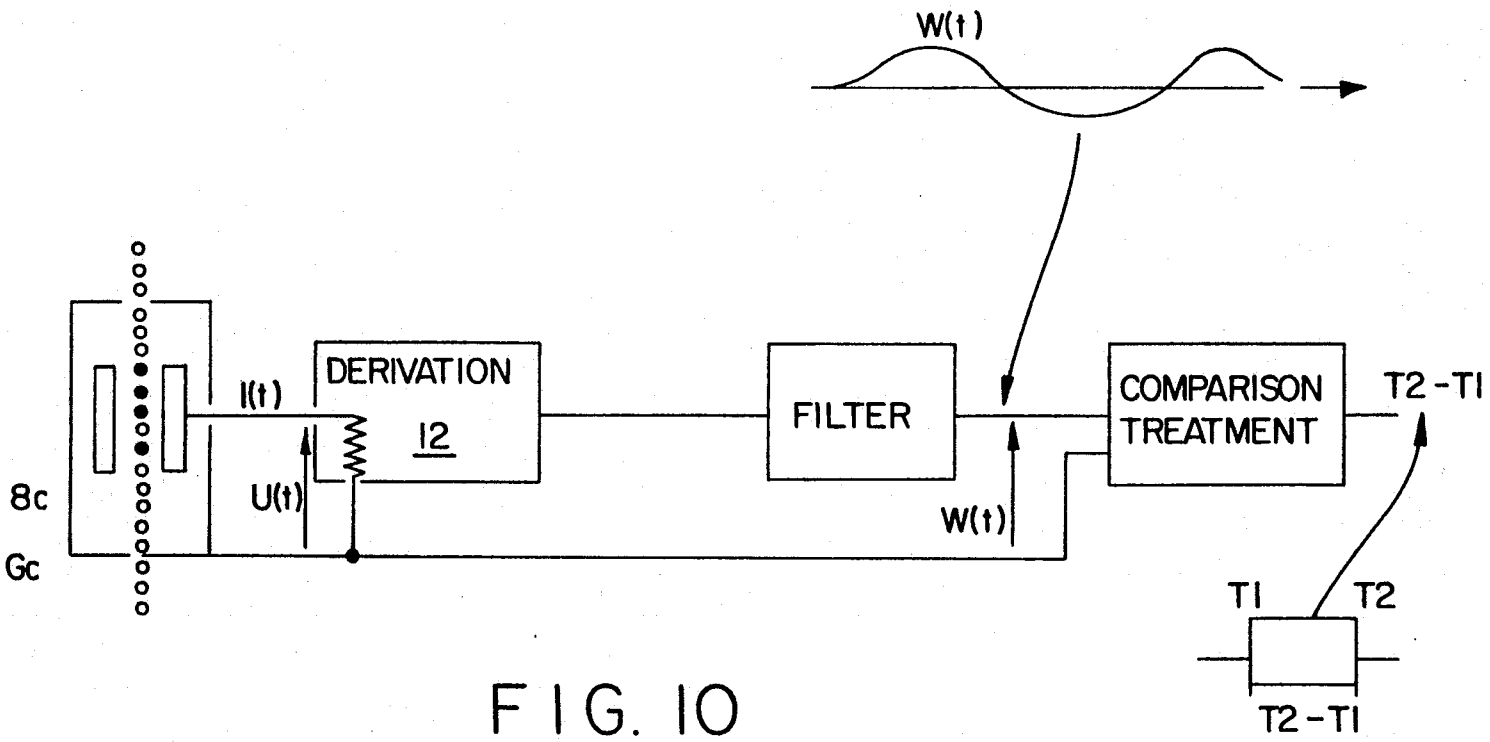
Figure 11:
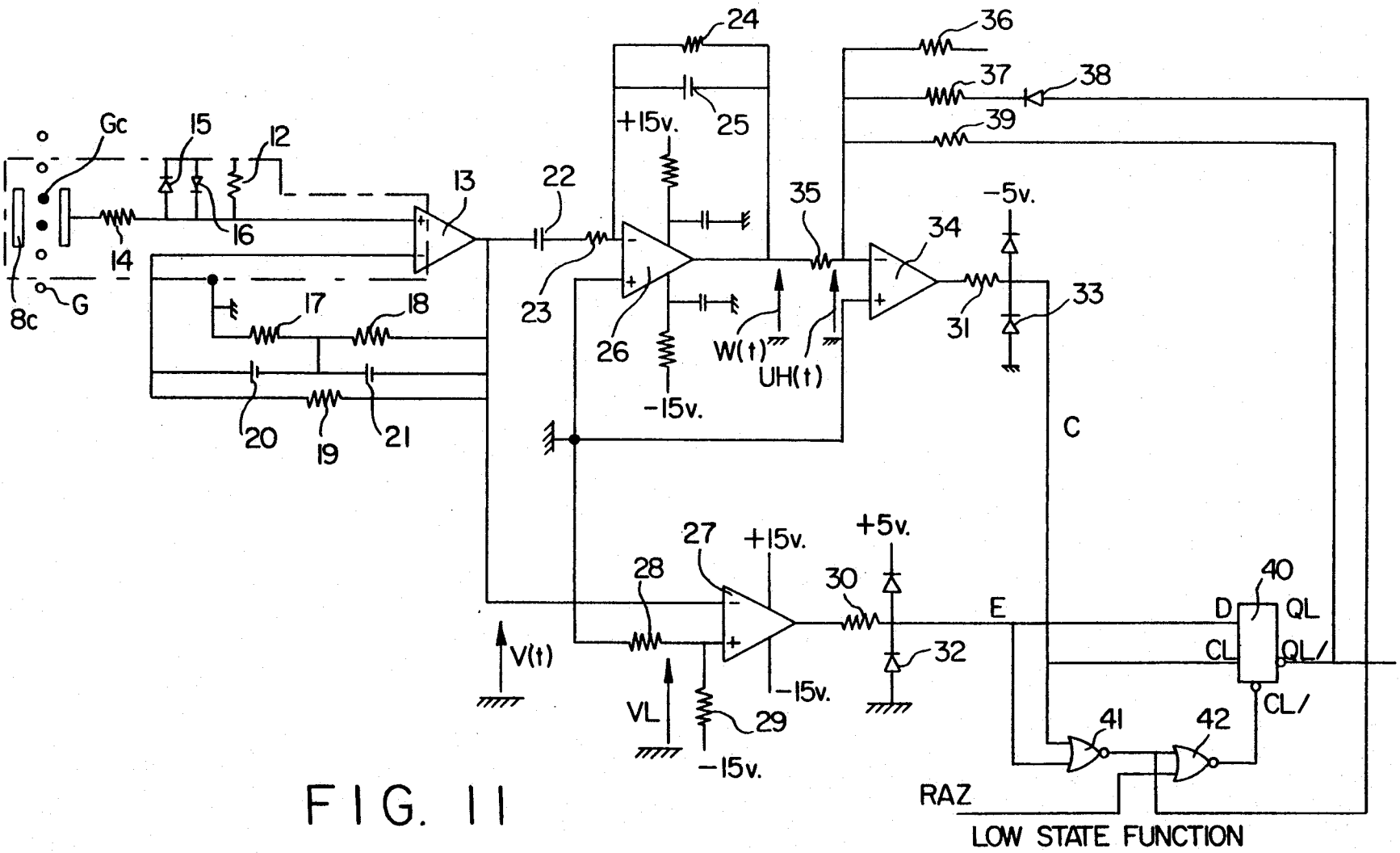
Figure 12:
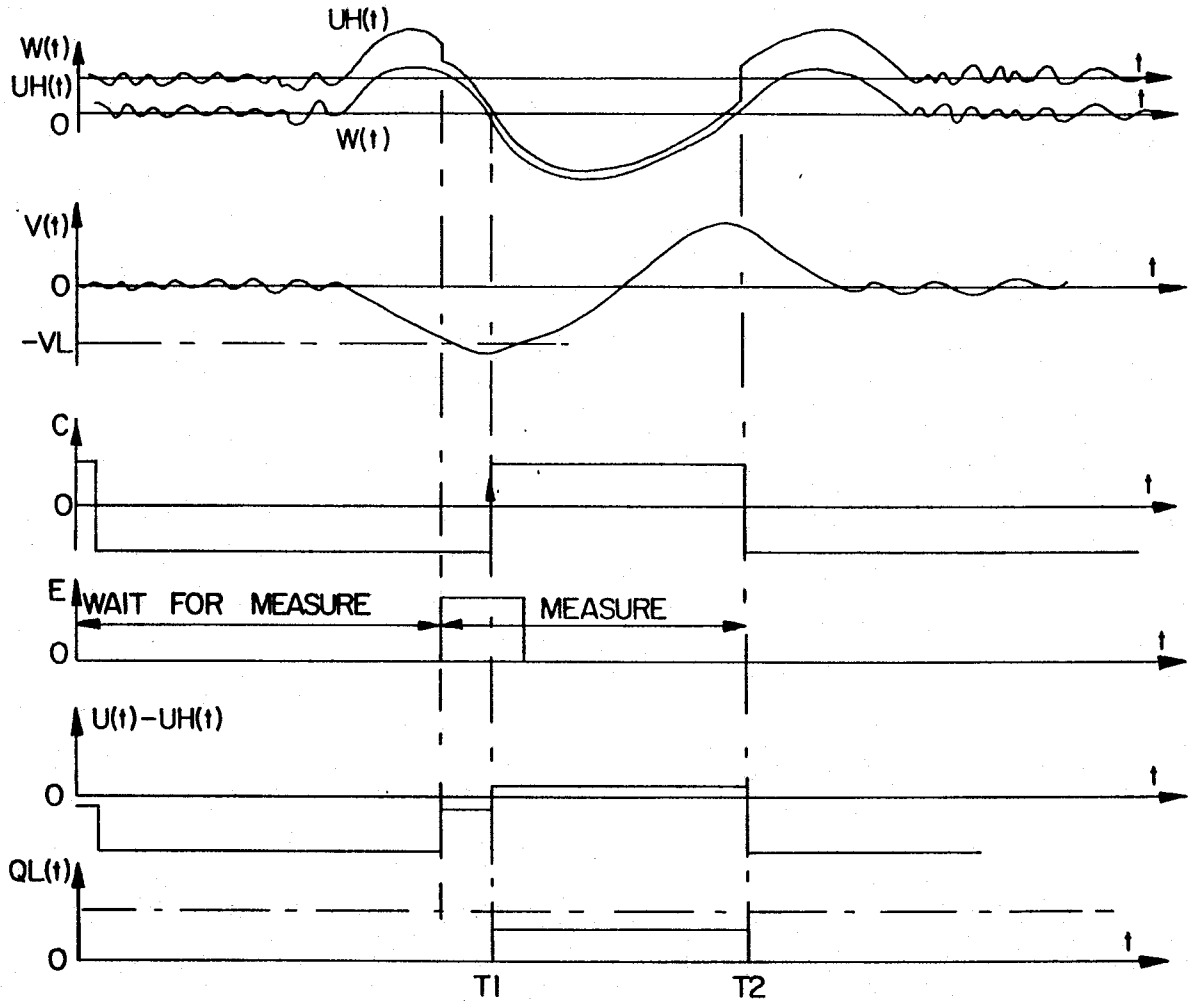
Figure 13:
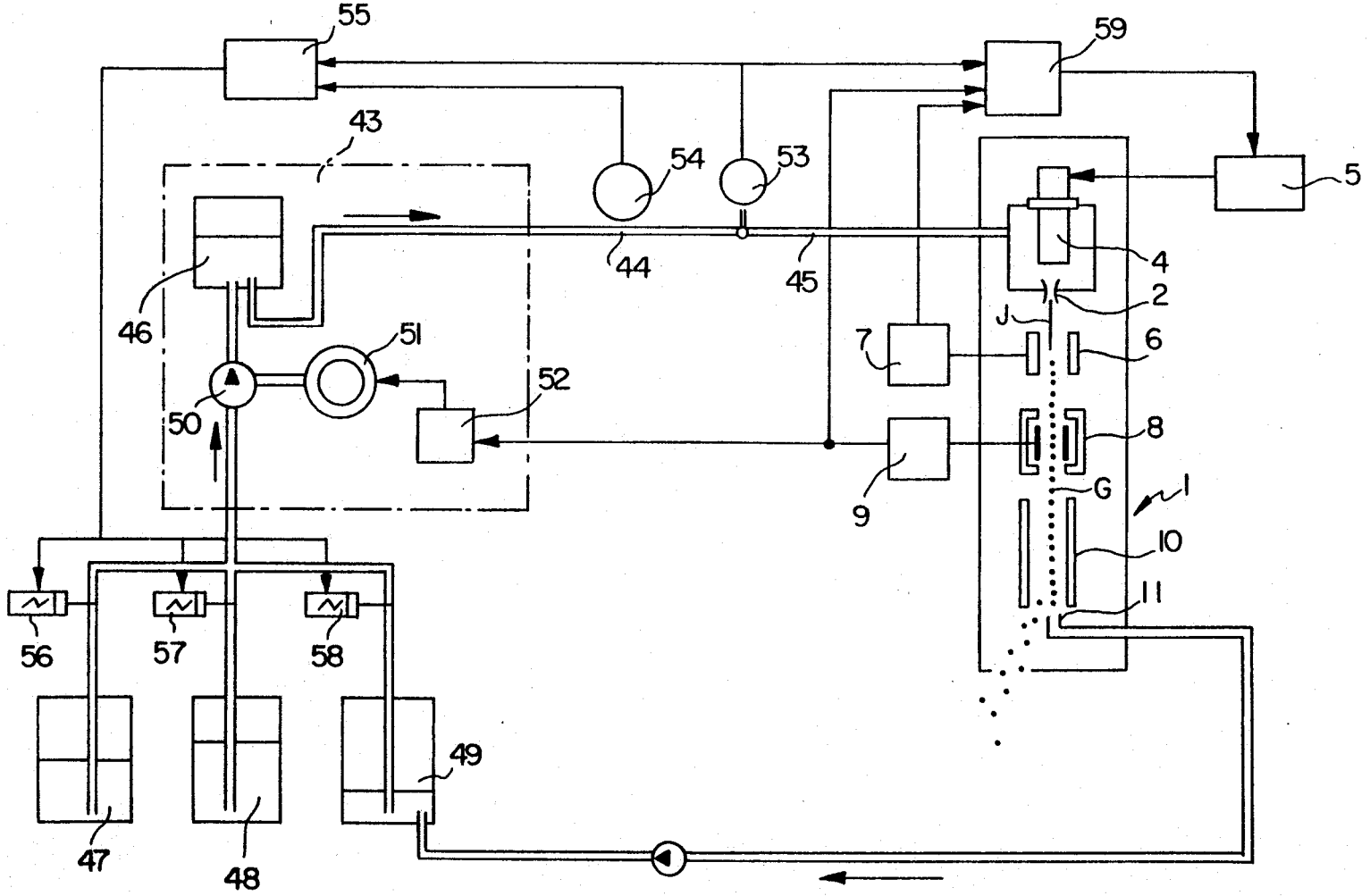
Figure 14:
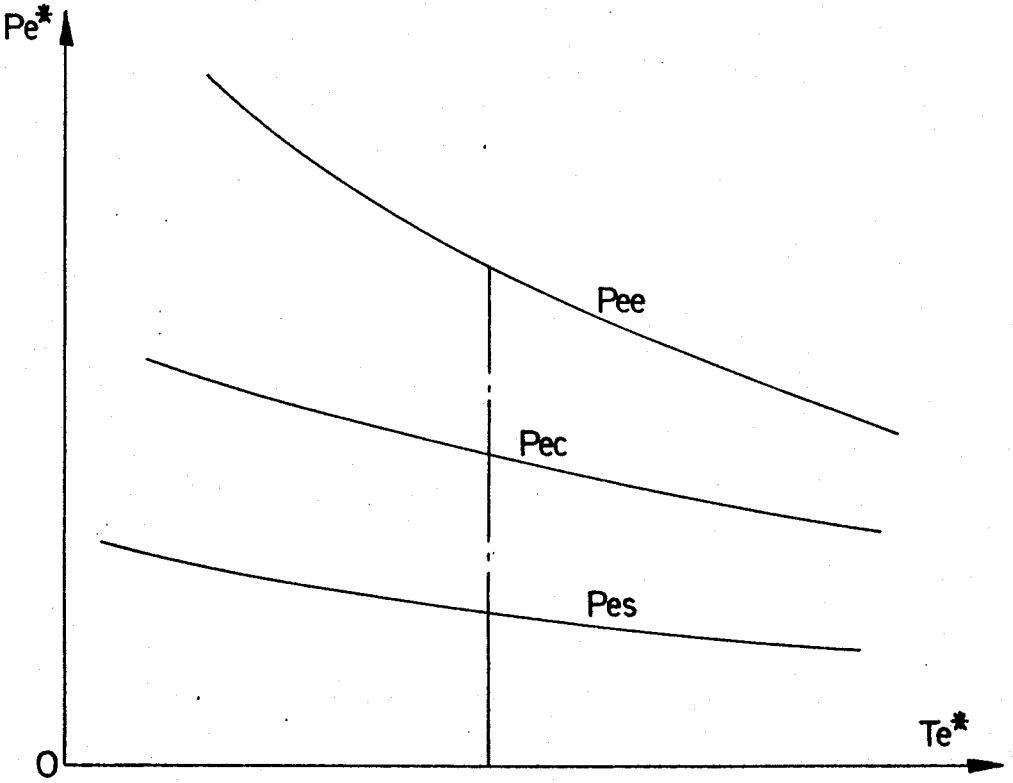
Figure 15:
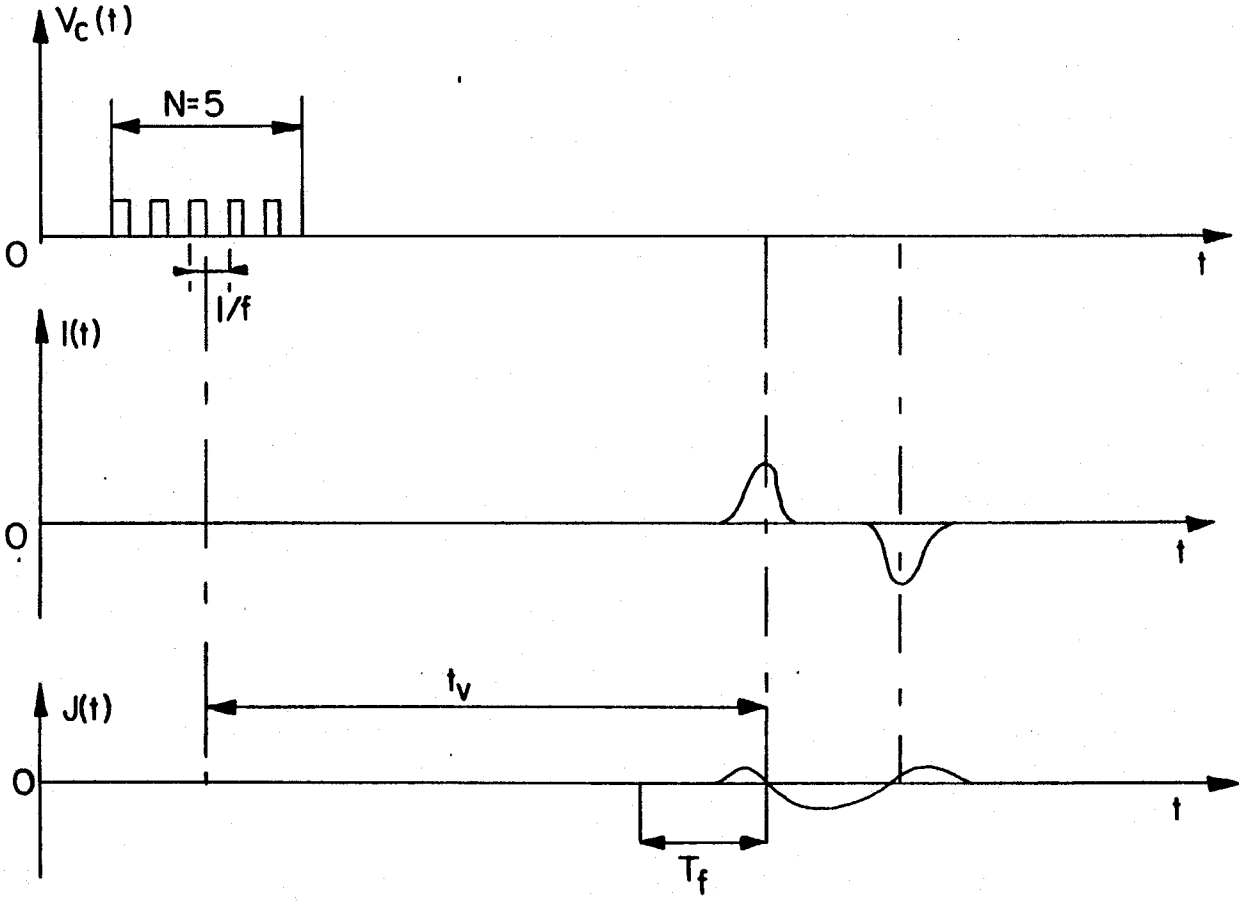

FIGS. 3*a* to 3*d* are views of structures associated with diagrams of the charge density per unit length induced in the detector by a charged drop as a function of its posit on with respect to said detector;

FIG. 4 is a diagram showing the charge Q(t) induced in the detector by a charged drop with respect to time;

FIG. 5 is a diagram showing the first derivative I(t) of Qt) with respect to time;

FIG. 6 is a diagram showing the second derivative J(t) of Qt) with respect to time;

FIG. 7 combines in superimposition the diagrams of I(t), J(t),QS(t), as well as two diagrams showing the values of three digital signals F1, F2 and F3 as a function of I(t) and J(t), and serving for determining the times at which a charged drop enters and leaves the detector;

FIG. 8 is a view similar to FIG. 3*b*, except that a train of charged drops is used instead of a single charged drop for the speed measurement;

FIG. 9 is a view combining the diagrams of I(t), J(t) and of the signals Fl, F2 and F3 for the case where a train of charged drops is used for the speed measurement;

FIG. 10 is a schematic view showing in the form of blocks the circuit associated with the detector for determining the drop speed;

FIG. 11 is a detailed view of the circuit of FIG. 10;

FIG. 12 is a view combining diagrams concerning the operation of the circuit of FIG. 11;

FIG. 13 is a schematic view illustrating the control and regulation device of the invention as a whole;

FIG. 14 is a diagram showing reference pressures as a function of the temperature concerning the components of the ink and an appropriate mixture of said components; and FIG. 15 combines the diagrams of I(t), J(t) and a diagram of the drop charging Vc(t) illustrating how the flight time of the drops is measured between the position at which they are formed and the inlet of the detector and, consequently, the length between the nozzle and said drop formation position.

Figure 1:
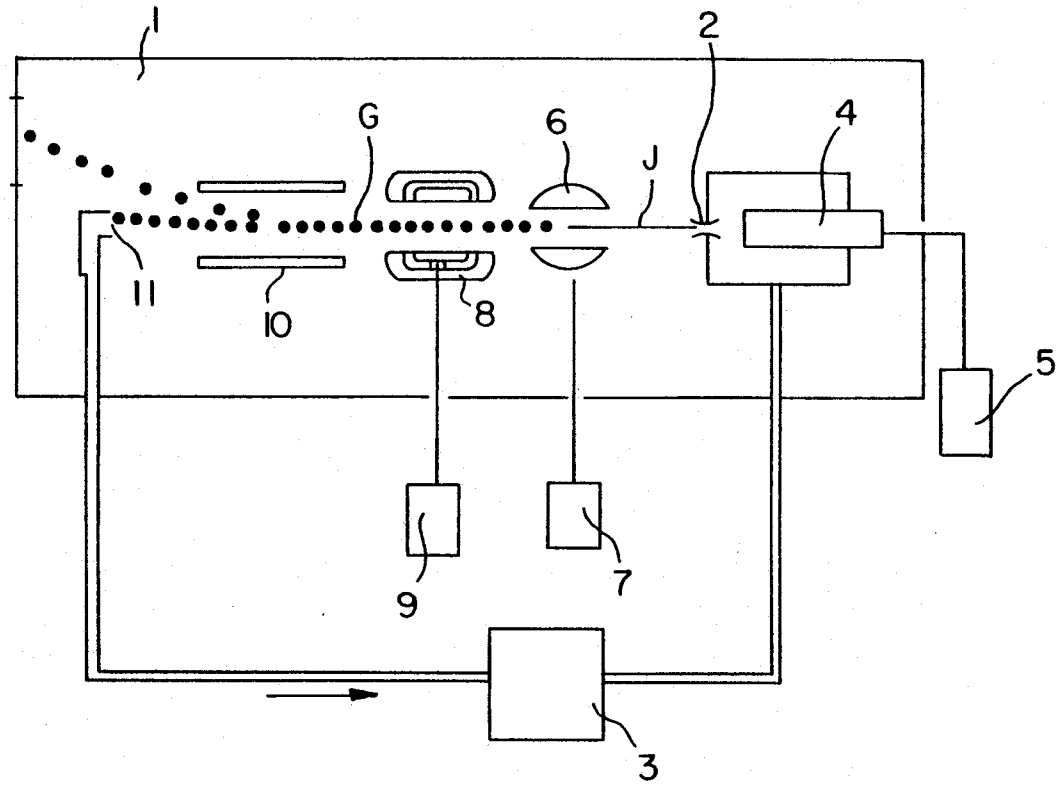
FIG. 1 is a schematic view showing the main elements of a printing head in a continuous ink jet printer according to the invention.

FIG. 1 illustrates the main mechanical and electric elements and an ink jet printing head 1 of the continuous jet type. It comprises particularly a nozzle 2 supplied with pressurized ink by an ink circuit 3 and creating a continuous jet J. Under the influence of the vibration of a resonator 4 fed by a modulation circuit 5, the continuous jet J is broken up at the centre of a charging electrode 6 into a continuous succession of equidistant and equidimensional droplets G. The charging electrode 6 is connected to a charging circuit 7. The droplets G, driven at a speed V substantially equal to the mean speed of the liquid in jet J then pass into a detector 8 used as jet phase and speed detector, and connected to an electric drop speed detection circuit 9. The charged drops are then deflected by a constant electric field maintained between deflection electrodes 10. The drops which are not or only little charged are recovered in a gutter 11, whereas the others continue their flight towards a recording medium, not shown. The drops recovered by gutter 11 are recycled to the ink circuit 3.

Figure 2:
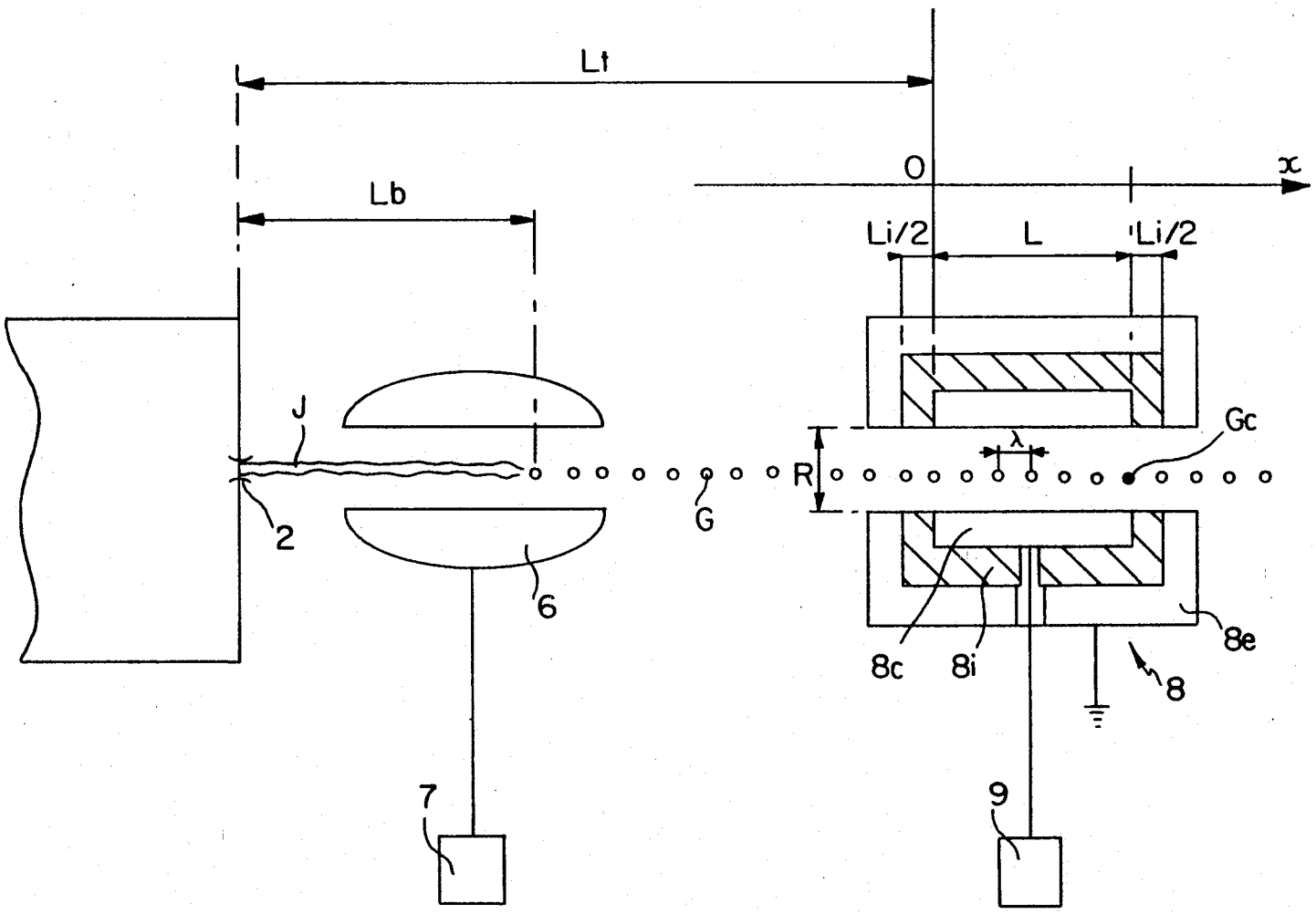
FIG. 2 is a schematic view, on a larger scale, showing the nozzle, a charging electrode and the detector for measuring the drop speed of the printing head of FIG. 1.

FIG. 2 illustrates schematically the charged drop speed detection electrode 8, placed immediately downstream of the position at which the drops are formed and charged. In the figure, the passage of a single charged drop Gc has been illustrated, with charge Qg, shown in black and situated close to the active conducting element 8*c* of detector 8. The latter is connected electrically to the electric drop speed detection circuit 9. The speed detection electrode 8 comprises a central conducting element 8*c*, preferably protected from the influence of external electric charges, present on the charging electrode 6 in particular, by means of an insulating thickness 8*i* and an external conducting element 8*e* called guard electrode, connected electrically to ground. In a preferred embodiment, detector 8 has a flat symmetry and drops G move in the axis of the slit formed along the axis of symmetry of the detector. However, any other configuration of the detector which is symmetrical with respect to axis of the path of the drops G may be suitable. Droplets G are driven at a substantially uniform translation speed V in the detector and are oriented along the axis of the detector.

In the schematically represented portion of FIGS. 3*a* to 3*d*, or upper portion of the figures, the charged drop is shown at four different relative positions with respect to detector 8, referenced x1, x2, x3 and x4, and corresponding to the times $t1=x2/V$, $t2=x2/V$, $t3=x3/V$, $t4=x4/V$, where the times and the abscissae are counted positively from the inlet of detector 8 and are related by the relation $x=Vt$. In these figures, the charged drop Gc is shown in a dark colour and the other non charged droplets situated downstream and upstream are shown with a light colour. The distance between the droplets G, referenced $\lambda$ is further related to speed V and to the modulation frequency f by the relation $\lambda=V/f$. Moreover, the prior art shows that for nominal operating conditions of the printer, this distance is related to the diameter of the nozzle by a relation of the type :

$$\lambda=4.5 \text{ to } 6\ OB$$

where OB is the diameter of the nozzle. To simplify we will choose the value 50B.

The proximity of the charged drop Gc (the charges are shown by signs—about the charged drop Gc in FIGS. 3*a* to 3*d*) leads by electrostatic influence to the appearance of electric charges of opposite sign on the surface of the detector (charges shown by signs + in FIGS. 3*a* to 3*d*). The amount of electric charges present on the detector varies depending on the axial distance x. If we neglect the influence of the insulator 8, this charge amount may be shown in the form of a charge density per unit length (x) given schematically in ordinates for different positions x1 to x4 of the charged drop Gc. In actual fact, in the vicinity of insulator 8, the distribution of electric charges is substantially modified and can only be calculated in all strictness with digital computation methods which are clumsy to use. However, to simplify the explanations which follow (text and Figures), the method of the invention will be described while disregarding the effects of the presence of the insulator 8*i* on the electric charge distribution. In practice, the influence of the insulator will be taken into account by replacing the length L of the active element 8*c* of the detector by an effective length Le=L+Li/2 where Li is the total length of the insulator measured along the path of the drops. With the above simplifications, in the case of a drop of small size with respect to the transverse dimension R of detector (width of the slit of the detector), the charge density per unit length may be approximated mathematically by the function :

$$\sigma(x) = \frac{Qg}{R}\left\{\cosh\left[\frac{2\pi(x - x_i)}{R}\right]\right\}^{-1} \quad (2)$$

The curve of charge density per unit length is symmetrical with respect to the position $x_i$ of the drop. As the relation (2) shows, the electric charges induced by the droplet on the detector are more concentrated close to the drop and practically non existent at a distance from the drop. The length S of the zone influenced electrically by drop Gc is shown in FIGS. 3*a* to 3*d*. From the relation (2) the length S of said zone verifies the relation :

$$S=2R \quad (3)$$

At a given time, the total charge carried by the active element 8*c* of effective length Le is referenced Q. It is defined by :

$$Q = \int_O^L \sigma(x)dx \quad (4)$$

Q corresponds to the hatched areas in FIGS. 3*a* to 3*d*. Q varies with the position x of the drop in the detection electrode 8*c*. The evolution of charge Q is shown in FIG. 4 as a function of time t=x/V reckoned along the path of the charged drop Gc. According to the invention, the dimensions of the detection electrode 8*c* verify the relation:

$S/2<Le$, namely according to (3) $R<Le$ (5)

This corresponds to a width R of the slit sufficiently small for half at least of the zone of length S influenced electrically by the droplet Gc to be contained in the effective length Le of the conducting element 8*c*. According to the invention, the charged drop Gc whose speed is to be measured is preceded downstream by at least n1 non charged drops, where n1 verifies the relation :

$$(n1+1)>(Le+R)/\lambda$$

or else, taking (1) into consideration $$n1>(Le+R)/(5\phi B)-1 \text{ approx.} \quad (6)$$

This condition allows the charged drop to enter the speed detector 8 while the previously charged drops are sufficiently far away so as not to influence the measurement.

Again according to the invention, the number n2 of non charged drops following the drop used for the speed measurement verifies the equality :

$$(n2+1)>(Lt+Le-Lb)/\lambda$$

where Lt is the distance which separates the nozzle from the detection electrode 8*c* and Lb is the length of jet J between the nozzle and the drop formation point, these distances being shown in FIG. 2. From which we deduce :

$$n2>(Lt+Le-Lb)/5\ \phi B - 1 \text{ approx.} \quad (7)$$

The condition (7) means that no drop is charged during the time when detector 8 is influenced by the drop Gc used for the speed measurement. In fact, despite the screening of the speed detection electrode 8*c*, it may be influenced by the charging voltage applied to the charging electrode 6. It is further preferable, during charging of the drop used for speed detection, to apply the charging voltage to the charging electrode during half at least of the drop formation period. This allows the drops to be charged correctly, while minimizing the interference to the measurement.

If the conditions (5), (6) and (7) are respected, the drop speed is then obtained by measuring the duration between times T1 and T2 corresponding to the two inflection points of the function Q(t), namely the relation :

$$V=Le/(T2-T1) \quad (8)$$

In relation (8), Le is the equivalent length of electrode 8*c*, characteristic of the measurement obtained by calibration by using another drop speed measurement method.

A practical measurement method is shown in FIGS. 5 to 7. The electronic measurement circuit 9 detects the current I(t) flowing between detector 8*e* and ground. This current is shown in FIG. 5 and corresponds to the drift with respect to time of Q(t), namely I(t)=dQ(t)/dt. The same electronic circuit 9 also measures the derivative J(t)=d(I)/dt of this current, so the second derivative of Q(t) shown in FIG. 6. J(t) is cancelled out at times T1 and T2 defined above.

A method of implementing the measurement of T2−T1 is described in FIG. 7. A count is triggered when simultaneously J(t) takes on a negative value and I(t) is greater than a threshold $+i_o$. The count is stopped when simultaneously J(t) takes on a positive or zero value and I(t) is less than $i_o$. The contents of the counter correspond then to the value T2−T1 to be measured. The representation of the digital processing is given by the diagrams of the digital signals F1, F2 and F3. The count lasts the time that the digital signal F3 is at the high logic level. The digital signal is at the high logic level when I(t) is greater than the threshold $i_o$ or less than the threshold $-i_o$. The digital signal F2 is at the high logic level when J(t) is positive or zero. The signal F3 passes to the high logic level during the downgoing front of F2, F1 being at 1. F3 passes again to zero during the following rising front of F2 whereas F1 is at 1.

The above described method of measuring the charged drop speed for the case of a charged drop requires drops not used for printing to be charged and so deflected. So as not to print useless drops on the recording medium, the charged drops for making the speed measurement are sufficiently little charged to be recovered in gutter 11. Considering the low charge level of these drops, in order to increase the signal/noise ratio of the device, it is necessary to make the measurement on a train of N equicharged and equidistant droplets. The charge density per unit length λN on electrode 8c of detector 8 corresponds, in this case, to the sum of the contributions of the N charged drops of the train of drops (the case for three charged drops is shown in FIG. 8). The sum of the contributions of the N charged drops is symmetrical with respect to the centre of the train of drops. Generally, the speed measurement method is similar to that set out above for the case of a single charged drop. Generalizations of the case of N drops of relation (5) may in a first approximation be written :

$$SN=(N-1)\lambda+2R<2\ Le \text{ or } N<1+2(Le-R)/5\ \phi B \text{ approx.} \quad (9)$$

This condition stipulates that the length SN of the detector influenced electrically by the train of N drops must be less than two lengths Le of the electrode.

Moreover, the other relations (6) and (7) characteristic of the implementation of the process become:

$$n1>(Le+SN)/\lambda-1 \quad (6')$$

$$n2>(Lt+Le-Lb)/\lambda-\tfrac{1}{2}-N/2 \quad (7')$$

Depending on the ratio λ/R, the density per unit length N may have several maxima, as shown in FIG. 8. In FIG. 9 have been shown the evolutions of the corresponding magnitudes I(t) and J(t) used for making the measurement. It will be noted that the magnitude I(t) has a trend similar to the density per unit length N. The result is that the zero cross-over points of the function J(t) may be multiple. A variant of processing the measurement consists in counting the time elapsing between the times corresponding to the rising fronts of the logic signal F2 at the high logic level when J(t) is greater than a value $J_o$ or less than a value $-J_o$, as shown in FIG. 9. However, in the preferred embodiment of the invention, an adapted electric circuit is used for shaping the signal which overcomes these disadvantages. The electric measurement circuit is described in greater detail below, in connection with FIGS. 10 and 11.

Processing of the signals for making the measurement results in shaping the time variations of the electric signals I(t), J(t). In practice, it proves necessary to filter the electric signals delivered by electrode 8c, for controlling transmission of the signal and minimizing the influence of parasite random signals. The electric drop speed measurement circuit 9 is as shown schematically in FIG. 10. The current I(t) resulting from the time variations of the electric charge Q(t) carried by the sensitive electrode 8c flow between this electrode and ground through a resistor 12. The voltage U(t) at the terminals of resistor 12 is processed successively by a by-pass and filtering, giving a signal W(t). The filtering solution selected is filtering of order 5 towards the high frequencies and of order 1 towards the low frequencies. Such filtering towards the high frequencies in particular eliminates from the processed signal W(t) the multiple zero cross-overs present in the unprocessed signal J(t), which result from the presence of several charged drops in the train of charged drops : compare J(t) with FIG. 9 and W(t) with FIG. 10.

A detailed description of the operation of the circuit is given below, in connection with FIG. 11. The function of the circuit is to determine the difference of the two characteristic times T2 and T1 corresponding to the cross-overs of the voltage W(t) of FIG. 10.

Pre-amplification of Q(t) is provided by an F.E.T. input amplifier 13 whose spectral input current noise density is very low, of the order of $10^{-14}$ amps/$\sqrt{\text{hertz}}$. The input resistor 12 defines a first derivative of the signal. The components comprising resistor 14 and diodes 15 and 16 form the input protection. The components comprising resistors 17, 18, 19 and capacitors 20 and 21 contribute to the filter function.

A capacitor 22 creates a second by-pass of the signal. The components comprising resistors 23, 24, capacitor 25 and amplifier 26 form the succession of the filter function.

A comparator 27 changes state by passing to a high level at its output when the first derivative of the charge of electrode 8c exceeds an amplitude VL, determined by resistors 28 and 29.

The components comprising resistors 30 and 31 and diodes 32 and 33 adapt the output voltages of the comparators to the voltages of the logic circuits.

A comparator 34 changes state at its output at the zero cross-overs of the voltage UH(t). Resistors 35 and 36 create the shift. A resistor 37 and a diode 38 create a voltage shift on W(t) in the stand-by phase of the measurement and a resistor creates a voltage shift on W(t) in the measurement phase. It is necessary to use the "shift" function so as to prevent the comparators from changing state random fashion at times when the amplitude of the charge derivative is low, and to avoid bouncing of the logic signals in the search for the zero cross-overs of the voltage UH(t). In this connection, resistors 35, 36 and 39 contribute to the quality of the measurement, thus the shift voltage generated must be sufficiently small and distributed about the zero potential.

The operation in time may be followed in FIG. 12. It will be noted that the measurement can only begin if the voltage V(t) is sufficiently negative (−VL). At that time, the signal E at the output of comparator 27 is at the high level. At this stage, a flip-flop 40 has a high level at its input D. Via NAND gates 41 and 42, the level CL/ passes to the high level and enables the flip-flop, the shift is reduced to that required for the measurement. When the rising front of signal C arrives from comparator 34, flip-flop 40 recopies the state present at the D input on the output QL, the output QL/ takes the opposite state, ensuring the shift of the voltage UH(t) required for hysteresis during the measurement. Time T1 being thus defined, the counting of time begins. When signal C passes to the low level, via gates 41 and 42, a shift is defined for the measurement stand-by, the level CL/ passes to the low level and places the flip-flop in the frozen state with output QL in the low state. The output QL/ takes on the opposite state, ensuring the shift of voltage UH(t) required in the measurement stand-by phase. Time T2 is thus defined. Counting of the time is stopped and the information T2–T1 is made available to the computer.

FIG. 13 shows schematically the different mechanical and electrical elements forming an ink jet printer, including a printing head 1 and an ink supply circuit. The following different elements are also shown : sensors, electric circuits, for implementing the method of controlling the ink quality, which is the object of the present invention. FIG. 13 illustrates in particular a printing head 1 comprising a nozzle 2 for forming a succession of droplets G, a charging electrode 6 and electric means 7 for charging the droplets, a detector detecting the speed of drops 8, deflection electrodes 10 and a gutter 11, already described in connection with FIG. 1. An ink circuit comprises a constant ink flow generator 43, independent of the variations of the environment, said generator 43 being connected hydraulically to nozzle 2 by ducts 44 and 45 in series, from a mixing reservoir 46 containing the ink intended for the nozzle. Two reservoirs 47 and 48 containing respectively fresh ink and solvent are connected hydraulically to reservoir 46, for adjusting the amounts of ink and solvents therein. Finally, a reservoir 49 contains the ink coming from the droplets not used for printing and recovered in gutter 11.

In the particular case of the embodiment shown in FIG. 13, the constant flow generator 43 is formed of a positive displacement pump 50 driven by a motor 51, a speed measurement device according to the invention and a circuit for regulating the speed of drops 52. In particular, the positive displacement pump 50 may consist of a multifunction cell comprising a variable volume chamber, such as described in the French patent application 86 17385 in the name of the present Applicant.

The circuit for regulating the drop speed motor 51 driving pump 50, so as to increase (or decrease) the output of pump 50, depending on whether the drop speed measured is less (or more) than a reference value Vo. A similar drop speed regulation process is described in particular in the U.S. Pat. Nos. 4 045 770 and 4 063 252 for the case of a magnetic ink jet printer.

Generator 43 is connected to nozzle 2 by a single duct defined by the series connection of ducts 44 and 45. Regulation of the drop speed is substantially tantamount to regulating the ink flow at the output of generator 43, flowing through ducts 44 and 45.

In accordance with the invention, a device 53 is provided for measuring the ink pressure Pe delivered by pump 50, placed between generator 43 and nozzle 2 and dividing the duct into an upstream part and a downstream part with respect to the flow direction of the fluid, already referenced respectively 44 and 45. The pressure Pe required for maintaining a fixed jet flow Qo (or a drop speed Vo) depends on the following parameters :

- on the variation (zp–zj) existing between the pressure measurement position and the jet J;
- on the geometric characteristics (cross-sections, lengths and shapes) of duct 45 situated between the pressure measurement position and jet J, and of nozzle 2;
- on the characteristics of the ink present in duct 45 between the pressure measurement position and jet J (viscosity, density), and in nozzle 2.

The relation between the pressure of the ink and these different parameters may in particular be written in the following form :

$$\underline{Pe}=K1\overline{\rho}\cdot Qo^2+K2\overline{\eta}Qo-\overline{\rho}g(zp\ zj) \quad (10)$$

where $\overline{\rho}$ represents the mean density of the ink in duct 45 and in nozzle 2;

$\eta$ represents the mean viscosity of the ink in duct 45 and in nozzle 2;

g represents the acceleration of gravity;

K1 and K2 are coefficients characterizing the geometry of the ink flow along duct 45 and in nozzle 2.

For a given installation, the variation (zp−zj) is known (by construction or on site measurement). The pressure Pe* taking into account the variation and defined above then only depends on the characteristics (density and viscosity) of the ink flowing through the ducts (duct 45 and nozzle 2) between the pressure measurement position and the jet.

$$Pe^*=Pe+\rho g(zp-zj)=K1\rho Qo^2+K2\eta Qo \quad (11)$$

The density of the ink $\rho$ contributes to the pressure loss Pe* by the first term of the right hand part of relation (11), which corresponds to a loss by inertia; the latter depends (via the coefficient K1) on the amplitude of the changes of flow section of the ink in the ducts situated between the pressure measurement position and the jet. The viscosity $\eta$ of the ink contributes to the pressure loss Pe* by the second term of the right hand part of the relation (11) which corresponds to a friction loss; the latter depends (via coefficient K2) on the diameter and the lengths of the ducts situated between the Pe* measurement position and the jet.

In a preferred embodiment, the diameter of duct 45 is much larger (more than ten times) than the diameter $\phi B$ of nozzle 2 situated at the end, and the length of the duct is relatively small, so that the pressure loss in these ducts is negligible with respect to the pressure loss in the nozzle, and thus the relation (11) may be written :

$$Pe^*=K_{1B}Qo^2+K_{2B}Qo \quad (12)$$

where $K_{1B}$ and $K_{2B}$ are parameters representative of the geometry of the nozzle 2, characterized by an orifice diameter $\phi B$ and an orifice length LB. In this case, the viscosity $\eta$ and the density of the ink $\rho$ appearing in relation (12) are representative of the values at the nozzle. Measurement of the pressure Pe* then makes it possible, for a given type of ink and nozzle, to control the quality of the ink flowing to the nozzle, immediately upstream of the drop formation position. The pressure Pe* measured using the above described principle results from a combined effect of the density $\rho$ and the viscosity $\eta$ of the ink flowing in the nozzle, such as given by the relation (12). These two parameters depend essentially on the solvent concentration in the ink and on the temperature of the ink. They both decrease when the temperature of the ink increases and when the amount of solvent in the ink increases.

For a given variation of concentration of the ink of 1%, for example, a relatively higher variation (30%) of the viscosity will generally be noted than of the density (1%). So as to increase the sensitivity of the measurement of Pe* to a variation of concentration of the ink, a nozzle 2 is preferably used whose slenderness (defined by the ratio of the length of the orifice to the diameter of the orifice) is at least equal to 1, so as to increase the value of the coefficient K2B in the relation (12) and to obtain a measurement more sensitive to the variations of quality of the ink, which results principally from viscosity variations.

The device for regulating the quality of the ink is shown schematically in FIG. 13. In accordance with the invention, a temperature sensor 54 is disposed in the ink circuit for making a temperature measurement representative of the temperature Te* of the ink at the nozzle. With the above assumptions concerning the diameter of duct 45, the mean speed of the ink in the duct is small (a few cm/s), so that the temperature of the ink is identical to the ambient temperature as long as the length of the duct is greater than about 50 cm. A simple measurement of the ambient temperature is then sufficient to implement the process described hereafter.

The ink pressure Pe* and temperature Te* measurements are transmitted to a control circuit 55. The latter, as a function of a quality reference of the ink to be maintained, which may in particular be defined by a curve Pe* (reference) −Te*, such as shown in FIG. 14, permanently regulates the quality of the ink by adding to the mixing reservoir 46 given amounts of fresh ink coming from reservoir 47, or solvent from reservoir 48, or ink recycled to gutter 11 and coming from reservoir 49, through an action on one of the electrovalves, respectively 56, 57 and 58.

According to the invention, the ink present in the fresh ink reservoir 47 is of a higher concentration than the nominal concentration of use. The curve Pee characterizing the quality of this fresh ink as a function of the temperature is shown in FIG. 14, as well as that of the solvent Pes. The main advantages of using concentrated make-up ink are a faster response time of the regulation of the ink quality and greater independent working of the machine in terms of new ink supply.

In a particular embodiment, the positive displacement pump 50 is formed of a variable volume chamber closed by a membrane, the latter being driven with a reciprocal movement by a stepper type motor. Pump 50 permanently supplies the printing head 1 with ink, through the mixing reservoir 46, the flow Qo being maintained constant by means of the regulation circuit 52. Regulation of the ink quality is obtained by adjusting the opening times of electrovalves 56, 57 and 58, controlled by the regulation circuit 55. The latter further operates in a sampled way with period dt. In order to take the time into account for mixing and transit of the ink between the mixing position 46 and nozzle 2, the regulation takes into account not only the quality of the ink measured at the present time, but of the whole record of the ink quality measured from the start-up of the machine. The method of regulating the ink quality is then provided in the following way :

Over a sampling period dt of the regulation circuit 55 the following mean values are defined, over the $i^{th}$ sampling period :

- the opening time De(i) of the fresh ink electrovalve 56,
- the opening time DE(i) of the solvent electrovalve 57,
- the opening time Dg(i) of the electrovalve 58 for ink recycled from gutter 11,
- the measured temperature of the ink Te*(i),
- the measured pressure Pe*(i) at the temperature Te*(i),
- the reference curve Pec(T) as a function of the temperature 5 (FIG. 14),
- the curve Pee (T) characteristic of the fresh ink (FIG. 14),
- the curve Pes (T) characteristic of the solvent (FIG. 14),
- the response time tr of the circuit between reservoirs 47, 48, 49 and nozzle 2 defined by the volume ratio of the duct to the flow per unit volume of jet Qo.

Let DP(i) be the instantaneous deviation of the ink quality with respect to the reference value :

$$DP(i)=Pe^*(i)-Pec(Te^*(i)).$$

The dynamic difference of the ink quality H(i) is defined :

$$H(i)=DP(i)+dt/Tp\ DP(n)$$

where n=0 corresponds to the start-up time of the ink circuit of the printer. The regulation is written :

| | |
|---|---|
| if \|H(i)\| < Ho | ink of satisfactory quality<br>then De(i) = 0<br>Ds(i) = 0<br>Dg(i) = dt |
| if H(i) > Ho | ink too concentrated<br>then De(i) = 0<br>Ds(i) = dt.ks. \|H(i) − Ho\|<br>Dg(i) = dt.(1 − Ks). \|H(i) − Ho\| |
| if H(i) < Ho | ink not concentrated enough<br>then De(i) = dt.Ke \|H(i) − Ho\|<br>Ds(i) = 0<br>Dg(i) = dt. (1 − Ke). \|H(i) − Ho\| |

where

Ke is proportional to |Pec(To)−Pee(To)|

Ks os proportional to |Pec(To) −Pes(To)|

To is the mean temperature of use

Tp is about 3tr.

FIG. 13 illustrates also the operating diagram of the device controlling the drop formation, which is the object of the invention. The device uses the printing head 1, comprising nozzle 2, fed by the ink circuit comprising the constant flow generator 43. Jet J from nozzle 2, whose speed is fixed (regulated) is broken up at a distance Lb, FIG. 2, from nozzle 2 into a succession of equidistant and equidimensional droplets G under the action of the pressure disturbance applied by resonator 4 placed upstream of nozzle 2 and fed by the modulation circuit 5. The charging circuit 7 cooperating with the charging electrode 6 charges the drops intended for printing.

According to the invention, an electric circuit 59 measures the flight time tv of the drops used for the speed measurement. This flight time tv is defined by the duration between the time of charging these drops and the time of detecting their passage at the input of the speed detector 8. A timing diagram of the operation of detector 59 is given in FIG. 15. The number of drops of the train used for the speed detection being known (five in FIG. 15) simple processing of the charge signals Vc(t) (the charging voltage Vc is applied to the charging electrode for a drop half period for the case shown in FIG. 15) and its speed detection I(t), J(t) allows the time tv to be obtained. The distance Lt (FIG. 2) between nozzle 2 and the input of detector 8 being known by construction, the distance Lb separating the nozzle from the drop formation and charging position is obtained by the relation below, which comprises both the drop speed V and the flight time tv, both controlled by the printer :

$$Lb=Lt-V.(tv-Tf) \qquad (13)$$

where Tf is a delay time characteristic of electronic filtering and is independent of the other parameters.

Experience further shows that, with the drop speed fixed by the above described regulation, there exists a single relation relating the ink quality to the nozzle, measured by the pressure Pe* and the break length Lb, for ensuring optimum drop formation and charging. The circuit regulating the drop formation 59 acts on the amplitude of the energization signal of resonator 4, so as to maintain the break position Lbopt, providing optimum formation of the drops, as a function of the type of ink used and of the quality of the ink flowing to the nozzle. Another advantage of the invention resides in the fact that such a method overcomes possible disparities in the characteristics of the resonators from one machine to another.

In the above described control means, all the parameters controlled (or representative of measurable values) are measured at the level of the nozzle. This makes regulation of the operation of the printer very precise. The precision which may be reached by these control means makes possible their use in ink jet printers used for high quality marking applications. It contributes generally to improving the quality of printing and the reliability of ink jet printers.

The following table gives by way of indication the values for three printing head models according to the invention :

| | Example 1 | Example 2 | Example 3 |
|---|---|---|---|
| f<br>Drop frequency | 125 kHz | 83.33 kHz | 62.5 kHz |
| R<br>Electrode slit width | 0.6 mm | 0.6 mm | 0.6 mm |
| L<br>Detector 8c length | 2 mm | 2 mm | 2.8 mm |
| Li<br>Insulator length | 1 mm | 1 mm | 1.2 mm |
| Le<br>Effective length of 8c | 2.39 mm | 2.375 mm | 3.25 mm |
| N<br>Number of charged droplets | 7 | 6 | 7 |
| ØB<br>Nozzle diameter | 40 μm | 55 μm | 70 μm |

We claim:

1. Device for controlling and regulating ink in a continuous ink jet printer in which a continuous ink jet (J) leaves a nozzle (2), comprising:

means (4, 5) for breaking-up said ink (J) by formation of said ink jet (J) into equidistant and equidimensional droplets (G);

a charging electrode (6) where said droplets are selectively electrostatically charged;

a charged drop speed detector (8);

deflecting electrodes (10) where said droplets (G) are deflected as a function of charge, wherein said detector (8) comprises firstly a central conducting element (8c) of length (L), in two symmetrical parts with respect to an axis of a path of the droplets (G), spaced by a distance (R), said conducting element (8c) being protected by a insulating element ($8_i$) of total length ($L_i$) from an influence of an external conducting element (8e) connected electrically to ground, satisfying the relations:

$$R<L_e \text{ and } L_e=L+L_i/2$$

$L_e$ being an effective length of said detector (8) and wherein said device further comprises an electric drop speed detection circuit (9) including means for measuring a charge per unit length ($\sigma_x$) according to the equation:

$$\sigma_x = \frac{-Qg}{R}\left[\cosh\left[\frac{2\pi(x-x_i)}{R}\right]\right]^{-1}$$

where Qg is a charge on the droplets and $x_i$ is a position of the droplets in the detector (8);

means for measuring an evolution of a total charge Q carried by the conductive element (8c) of effective length (Le) according to the equation:

$$Q=\int_o^L \sigma(x)dx;$$

means for measuring the evolution of said total charge Q with respect to a time f(t) according to the following:

$$Q=f(t)$$

means for measuring a first derivative I(t) and a second derivative J(t) with respect to the time of total charge Q means for calculating the drop speed V with the two inflexion points of the function Q=f(t) corresponding to time $T_1$ and $T_2$, by the relation:

$$V=Le/(T_2-T_1).$$

2. Device according to claim 1 wherein a charging voltage on the charging electrode (6) is only applied during half of a period of formation of the droplets used for a speed measurement.

3. Device according to claim 1 further comprising means for separating a charged droplet (Gc) serving for making a speed measurement, with respect to other charged droplets, so that said charged droplet (Gc) is preceded by at least (n1) non charged droplets and followed by at least (n2) charged droplets, (n1) and (n2) satisfying the relations:

$$n1>(Le+R)/5\phi)-1, \text{ approximately;}$$

$$n2>(Lt+Le-Lb)/(5\phi B-1), \text{ approximately,}$$

where ϕB is a diameter of the nozzle (2), Lt is a distance between the nozzle (2) and an input of the detector (8), and Lb is a distance between the nozzle (2) and the droplets formation position.

4. Device according to claim 1 further comprising means for separating a train of (N) successive charged droplets serving for making a speed measurement with respect to other charged droplets, so that said train of (N) successive charged droplets is preceded by at least (n2) non-charged droplets, (n1) and (n2) satisfying the relations:

$$n1>(Le+SN/2)/\lambda-1;$$

$$n2>(Lt+Le-Lb)/\lambda-\tfrac{1}{2}-N/2;$$

where λ is a distance between two successive droplets and S is a length of a zone influenced electronically by a charged droplet (Gc).

5. Device according to claim 1 further comprising means for controlling the charge of the droplets (Gc) used for the speed measurement, so that the charge of said speed measurement droplets (Gc) is less than other charged droplets (Gc) used for printing, said speed measurement droplets (Gc) being then recovered in a gutter (11) of the printer.

6. Device according to claim 1 further comprising a means (52) for regulating the drop speed acting on a motor (51) driving a pump (50) in an ink supply circuit for the nozzle (2) depending on whether the drop speed measured is less or more than a reference value Vo.

7. Device according to claim 6, further comprising a sensor detecting a pressure of the ink (Pe*) in a duct (44, 45) between a constant ink flow generator (43) formed by the pump (50) and the motor (51) and the nozzle (2), immediately upstream of the nozzle (2), so as to reduce a concentration of the ink as a function of said pressure, of a given temperature of use and the speed of the droplets.

8. Device according to claim 7 wherein the duct between the flow generator (43) and the nozzle (2) has a diameter which is about ten times greater than a diameter of the nozzle (2).

9. Device according to claim 8 wherein a ratio between a length and a diameter of an orifice of the nozzle (2) is at least equal to 1.

10. Device according to claim 7 further comprising a temperature sensor (54) for measuring a temperature representative of a temperature (Te*) of the ink at the nozzle (2).

11. Device according to claim 10 further comprising means (55) for regulating ink quality as a function of the pressure (Pe*), temperature (Te*) measurements and a reference curve of the pressure as a function of the temperature for a given drop speed (Vo).

12. Device according to claim 11 wherein the ink quality is regulated in a mixing reservoir (46), from a fresh ink reservoir (47), a solvent reservoir (48) and a reservoir (49) for ink recycled to the gutter (11), the regulating means (55) actuating selectively electrovalves (56, 57, 58) in respective ducts between the fresh ink, solvent, and recycle reservoir (47, 48, 49) and the mixing reservoir (46).

13. Device according to claim 12 wherein the ink in the reservoir (47) has a higher concentration than a nominal value of use.

14. Device according to claim 11 wherein the regulating means (55) comprise a processing circuit taking into account the ink quality at a present time and a record of the ink quality from a start-up of the flow generator.

15. Device according to anyone of claims 1 to 14 further comprising means (59) for determining a distance between the droplets formation position and the nozzle (2), and for acting on an amplitude of a signal energizing the means (4, 5) serving for forming said droplets (G) so that the distance ensures optimum formation of the droplets, depending on a type and a quality of ink used flowing through the nozzle.

* * * * *